US008723785B2

(12) United States Patent
Sugimoto et al.

(10) Patent No.: US 8,723,785 B2
(45) Date of Patent: May 13, 2014

(54) LIQUID CRYSTAL DISPLAY AND DRIVING METHOD OF LIQUID CRYSTAL DISPLAY

(75) Inventors: Hideki Sugimoto, Kanagawa (JP); Hiroshi Hasegawa, Kanagawa (JP)

(73) Assignee: Sony Corporation (JP)

( * ) Notice: Subject to any disclaimer, the term of this patent is extended or adjusted under 35 U.S.C. 154(b) by 1094 days.

(21) Appl. No.: 12/692,999

(22) Filed: Jan. 25, 2010

(65) Prior Publication Data

US 2010/0188439 A1 Jul. 29, 2010

(30) Foreign Application Priority Data

Jan. 29, 2009 (JP) ..... 2009-017946

(51) Int. Cl.
*G09G 3/36* (2006.01)

(52) U.S. Cl.
USPC ..... 345/103; 345/102; 345/104

(58) Field of Classification Search
USPC ..... 345/690, 102–104
See application file for complete search history.

(56) References Cited

U.S. PATENT DOCUMENTS

| | | | | |
|---|---|---|---|---|
| 7,583,248 | B2 * | 9/2009 | Bou-Chi et al. | 345/102 |
| 2002/0044116 | A1 * | 4/2002 | Tagawa et al. | 345/87 |
| 2004/0017348 | A1 * | 1/2004 | Numao | 345/92 |
| 2004/0252097 | A1 * | 12/2004 | Kaneki et al. | 345/102 |
| 2006/0103637 | A1 * | 5/2006 | Yamaguchi et al. | 345/175 |
| 2007/0109252 | A1 * | 5/2007 | Shin et al. | 345/102 |
| 2008/0273140 | A1 * | 11/2008 | Kang et al. | 349/61 |
| 2010/0134402 | A1 * | 6/2010 | Groot Hulze | 345/102 |
| 2011/0228182 | A1 * | 9/2011 | Lee et al. | 349/15 |

FOREIGN PATENT DOCUMENTS

| | | |
|---|---|---|
| CN | 101794562 | 7/2012 |
| JP | 2000-275605 | 10/2000 |
| JP | 2000-321551 | 11/2000 |
| JP | 2002-221702 | 8/2002 |
| JP | 2003-149626 | 5/2003 |
| JP | 2004-062134 | 2/2004 |
| JP | 2006-030834 | 2/2006 |
| JP | 2006-119206 | 5/2006 |
| JP | 2007-206651 | 8/2007 |
| JP | 2010-141370 | 6/2010 |

OTHER PUBLICATIONS

Official Action (with English translation) for Chinese Patent Application No. 201210183083.3 dated Feb. 8, 2014, 10 pages.

* cited by examiner

*Primary Examiner* — Jonathan Horner
(74) *Attorney, Agent, or Firm* — Sheridan Ross P.C.

(57) ABSTRACT

A liquid crystal display includes: a transmissive liquid crystal display device having a display region made up of pixels arrayed in a matrix fashion. The liquid crystal display device includes a planar light source unit formed of planar light source units corresponding to respective display region units on an assumption that the display region is divided into the display region units and configured in such a manner that each planar light source unit irradiates a corresponding display region unit with light, and a drive circuit driving the liquid crystal display device and the planar light source device. The liquid crystal display device is scanned line-sequentially and the pixels making up each display region unit are scanned line-sequentially. A planar light source unit corresponding to a display region unit is held in a luminous state over a predetermined period since a line-sequential scan on the display region unit has been completed.

7 Claims, 14 Drawing Sheets

[EMBODIMENT]
FIRST DIRECTION
SECOND DIRECTION
90
LIQUID CRYSTAL DISPLAY DEVICE DRIVE CIRCUIT
TIMING CONTROLLER
91
CONTROL SIGNAL [R]
CONTROL SIGNAL [G]
CONTROL SIGNAL [B]
11
12
10
41
40
SCL
CLK1
SCAN CIRCUIT
92
INPUT SIGNAL [R]
INPUT SIGNAL [G]
INPUT SIGNAL [B]
CLK
DISPLAY CIRCUIT
CLK
CLK1
70
PLANAR LIGHT SOURCE DEVICE CONTROL CIRCUIT
80
PLANAR LIGHT SOURCE UNIT DRIVE CIRCUIT
BCL

[EMBODIMENT]

[EMBODIMENT]

[EMBODIMENT]

[REFERENCE EXAMPLE]

[EMBODIMENT]

[EMBODIMENT]

[REFERENCE EXAMPLE :VIDEO DISPLAY PERIOD $T_6$ -$T_{25}$]

[REFERENCE EXAMPLE :BLACK DISPLAY PERIOD $T_{26}$-$T_5$']

[EMBODIMENT :BLACK DISPLAY PERIOD $T_6$-$T_{25}$]

[EMBODIMENT :VIDEO DISPLAY PERIOD $T_{26}$-$T_5$']

[REFERENCE EXAMPLE]
FIG.8A [ PERIODS $T_1$ - $T_5$]
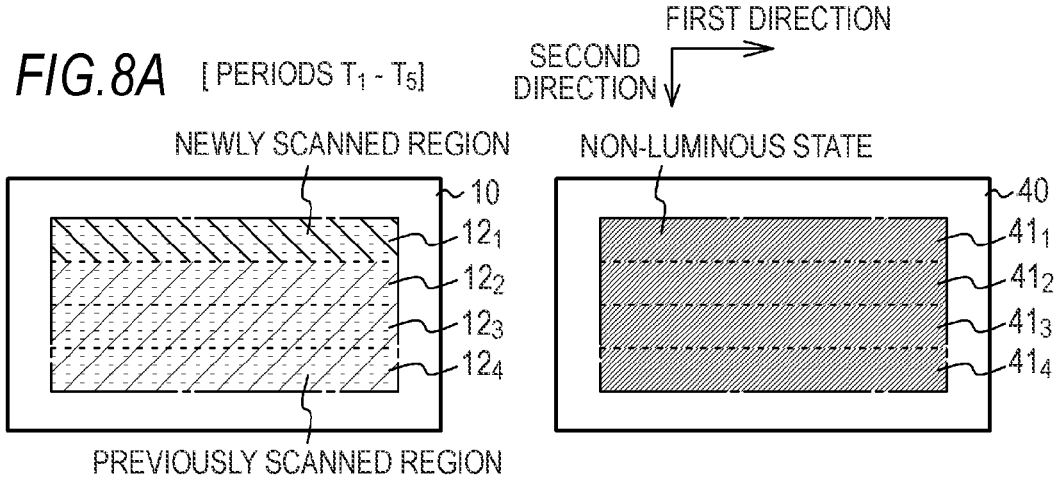
FIG.8B [ PERIODS $T_6$]
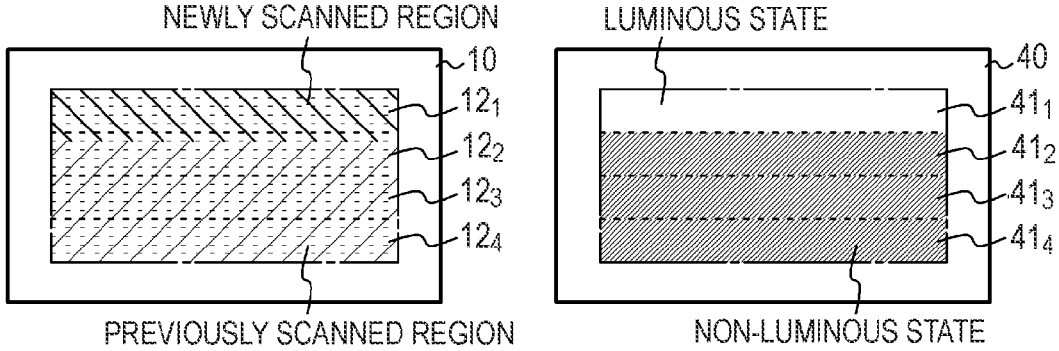
FIG.8C [ PERIODS $T_7$ - $T_{10}$]
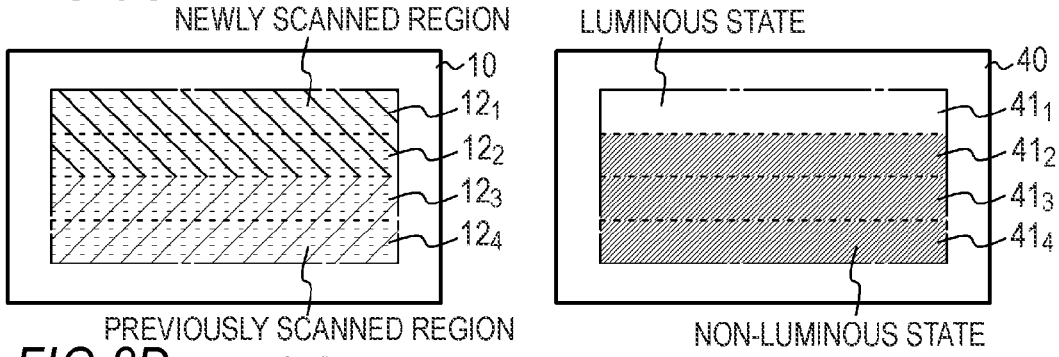
FIG.8D [ PERIODS $T_{11}$]
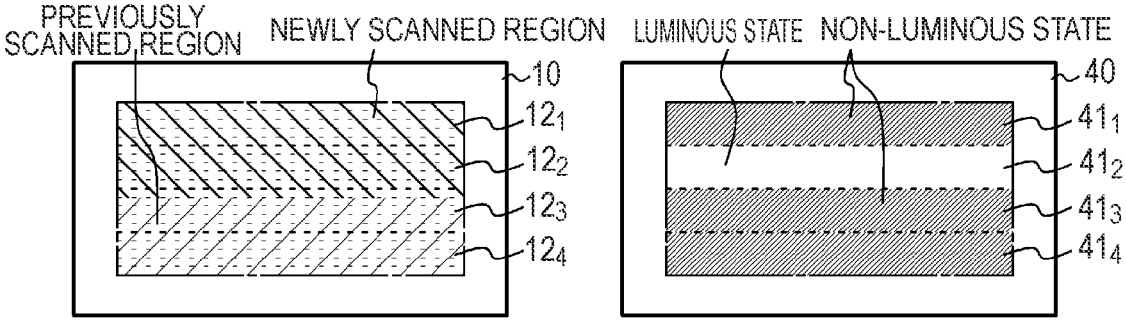

[REFERENCE EXAMPLE]
FIG.9A [ PERIODS $T_{12}$ - $T_{15}$]
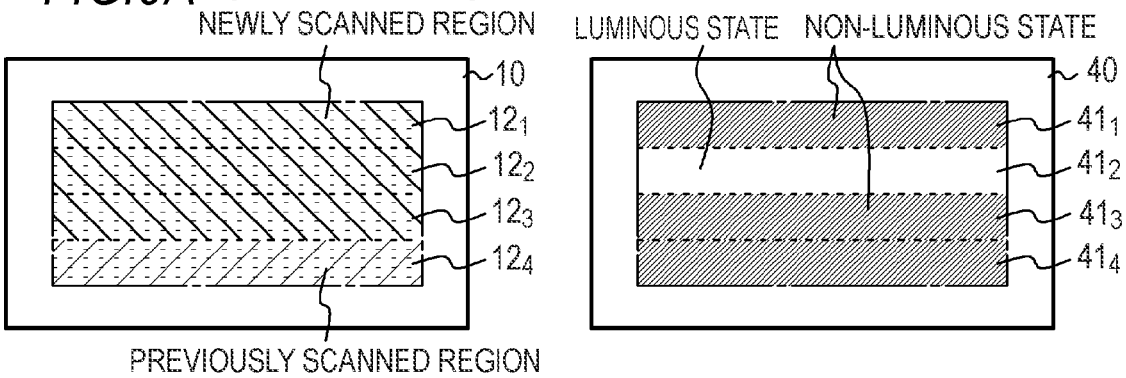
FIG.9B [ PERIODS $T_{16}$]
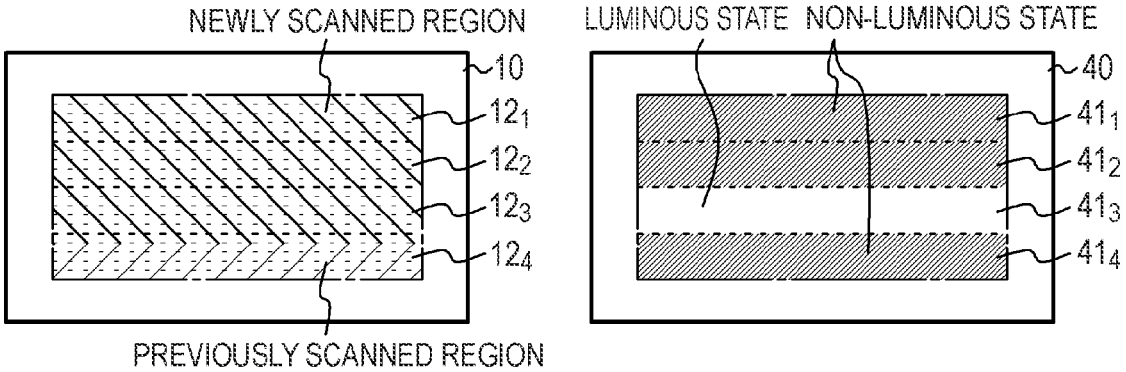
FIG.9C [ PERIODS $T_{17}$ - $T_{20}$]
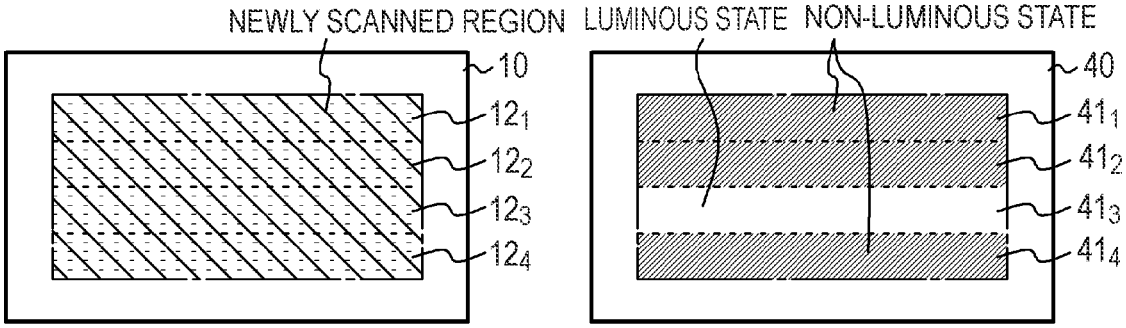
FIG.9D [ PERIODS $T_{21}$]
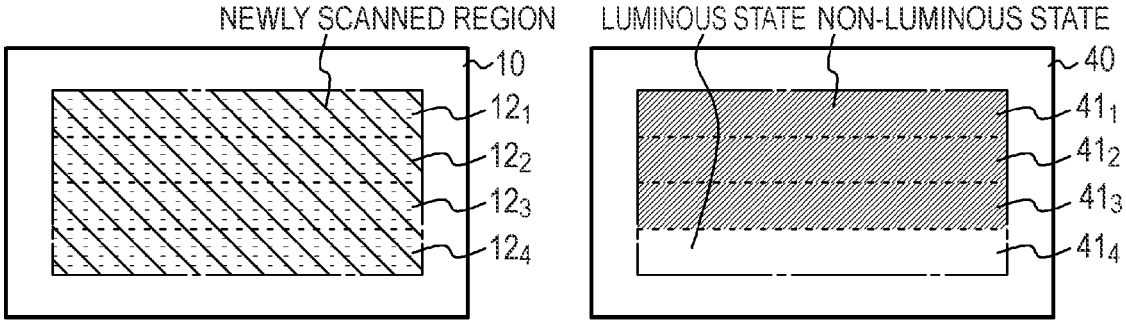

[REFERENCE EXAMPLE]
FIG.10A [PERIODS $T_{22}$ - $T_{25}$]
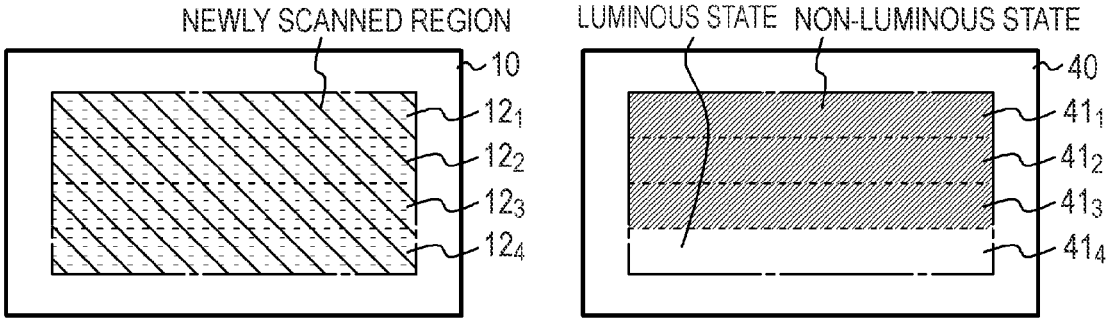
FIG.10B [PERIODS $T_{26}$ - $T_{40}$]
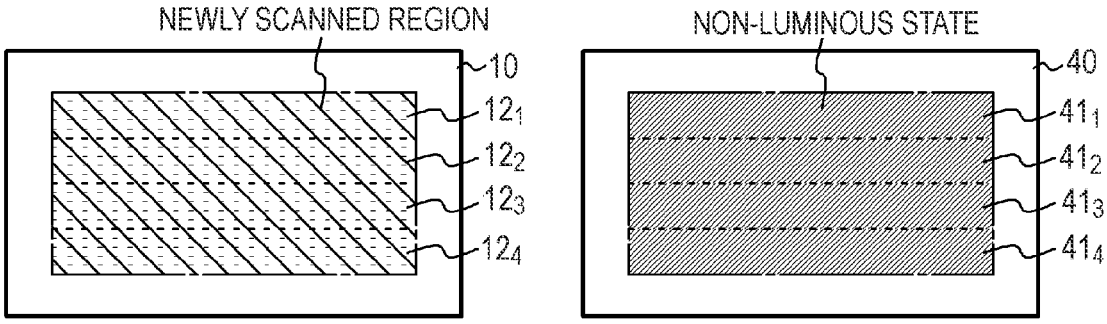
FIG.10C [PERIODS $T_1'$ - $T_5'$]
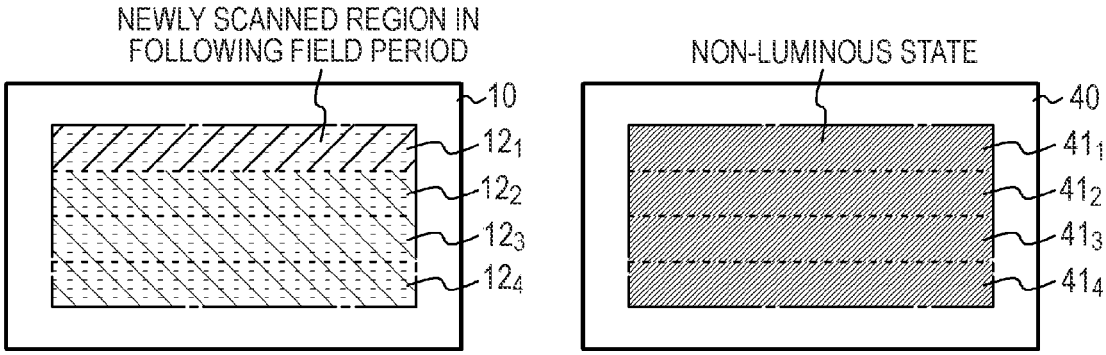

[EMBODIMENT]
FIRST DIRECTION
SECOND DIRECTION
FIG.11A [ PERIODS $T_1$ - $T_5$]
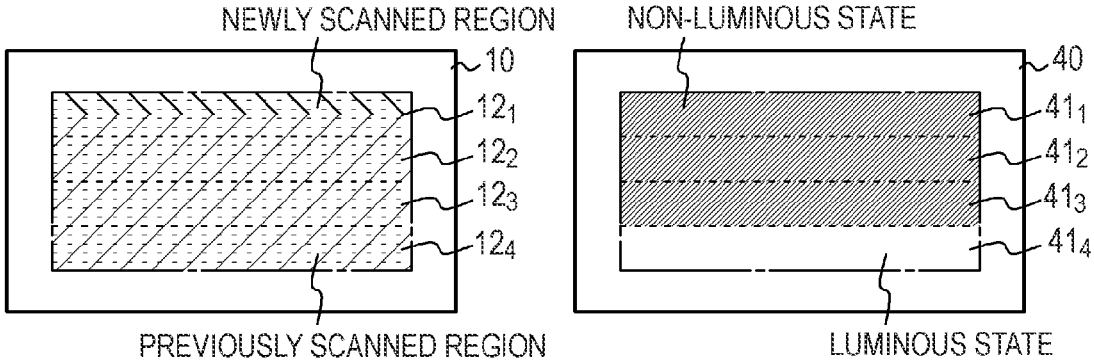
FIG.11B [ PERIODS $T_6$]
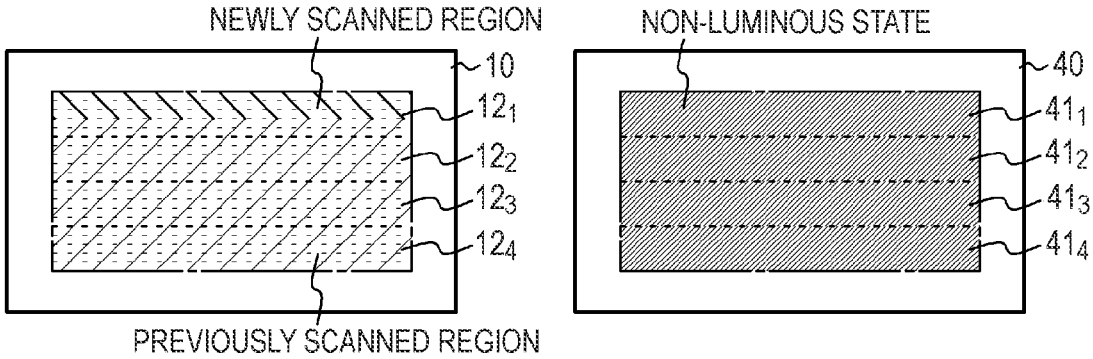
FIG.11C [ PERIODS $T_7$ - $T_{25}$]
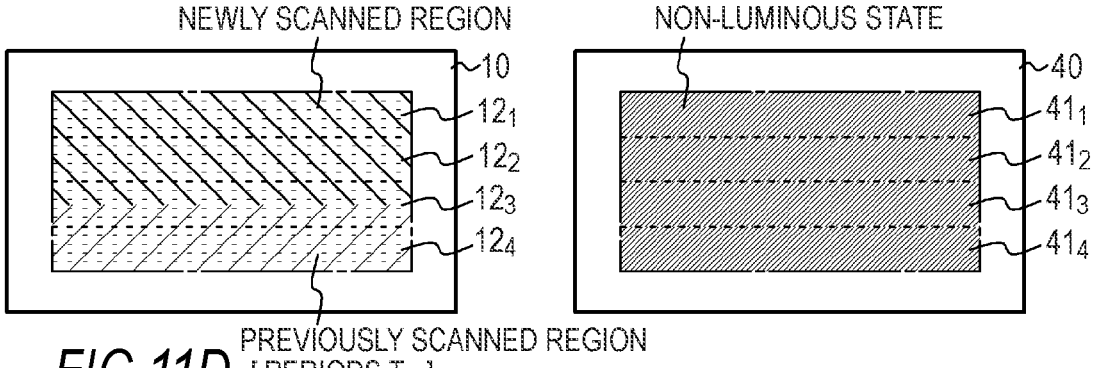
FIG.11D [ PERIODS $T_{26}$]
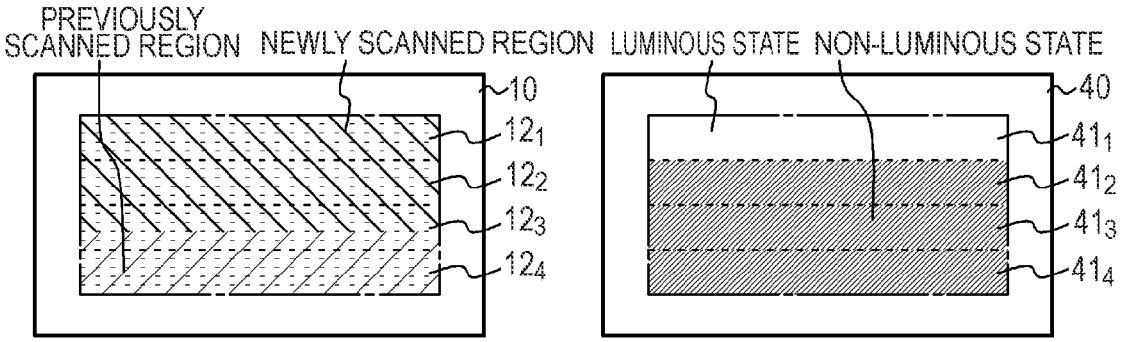

[EMBODIMENT]
FIG.12A [PERIODS $T_{27}$ - $T_{30}$]
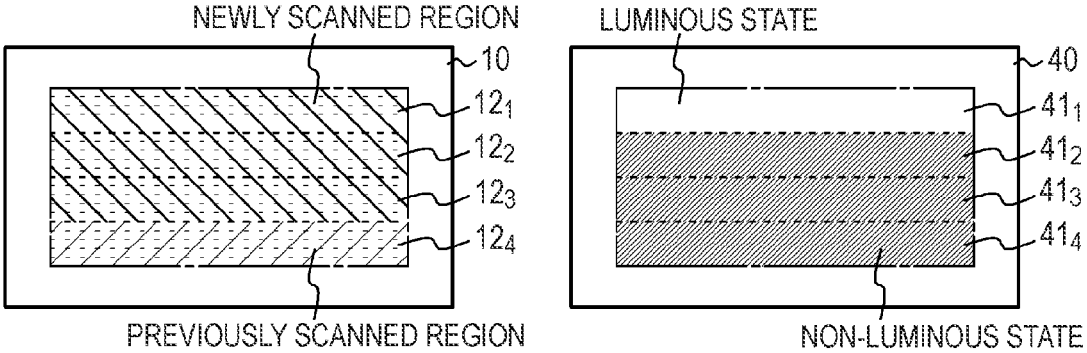
FIG.12B [PERIODS $T_{31}$]
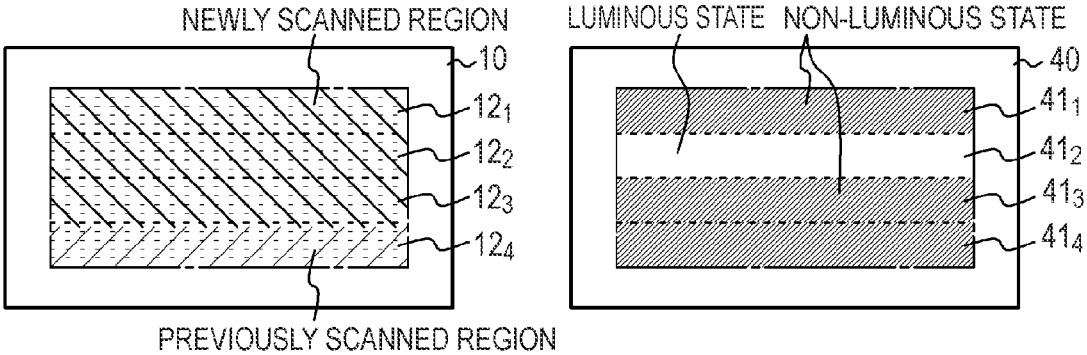
FIG.12C [PERIODS $T_{32}$ - $T_{35}$]
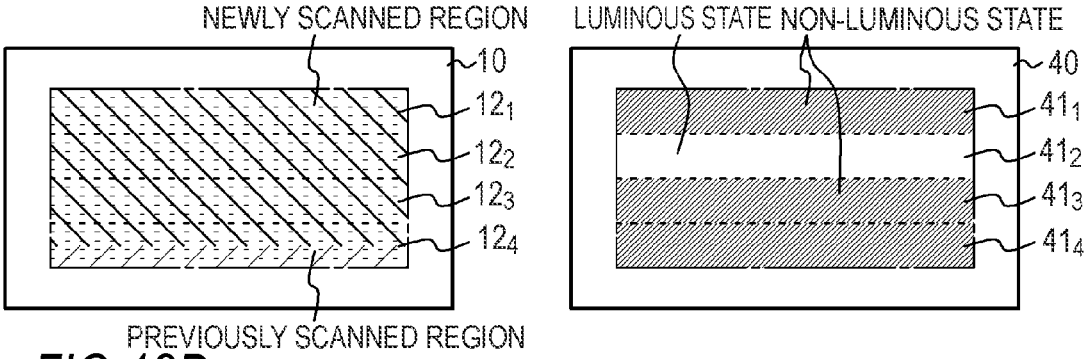
FIG.12D [PERIODS $T_{36}$]
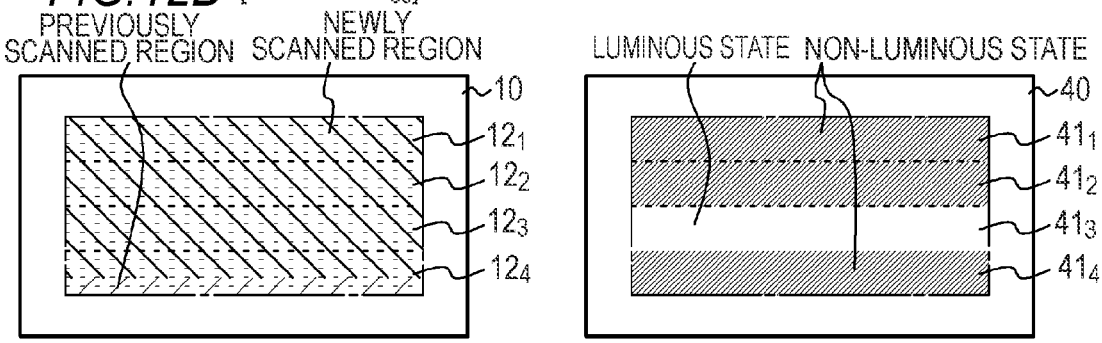

[EMBODIMENT]
FIG.13A [PERIODS $T_{37}$ - $T_{40}$]
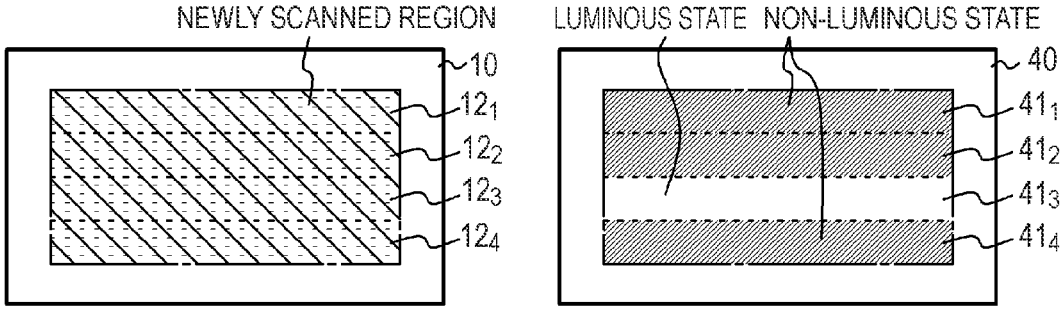
FIG.13B [PERIODS $T_1$' ]
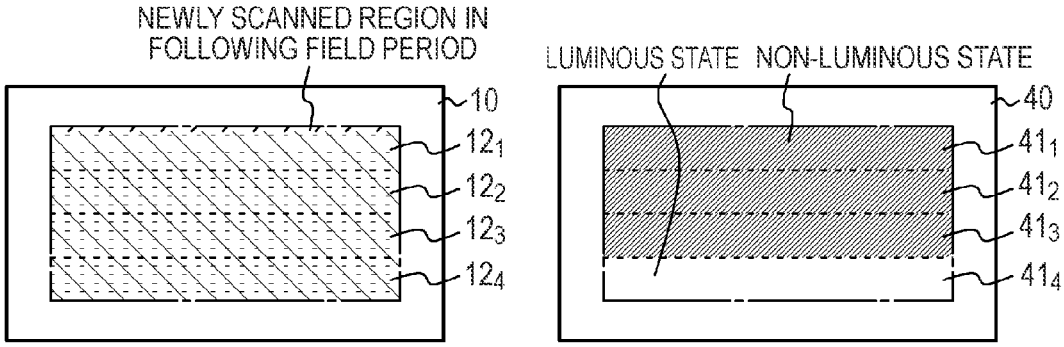
FIG.13C [PERIODS $T_2$' - $T_5$']
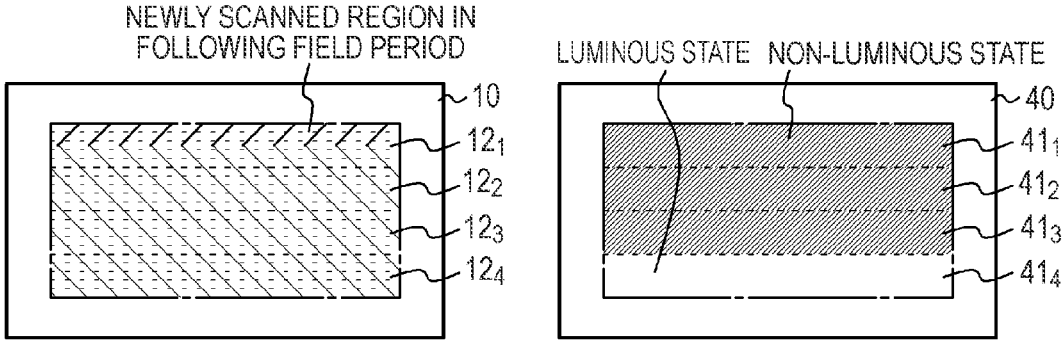

[EMBODIMENT]

LIQUID CRYSTAL DISPLAY AND DRIVING METHOD OF LIQUID CRYSTAL DISPLAY

BACKGROUND OF THE INVENTION

1. Field of the Invention

The present invention relates to a liquid crystal display and a driving method of a liquid crystal display.

2. Description of the Related Art

In a liquid crystal display device, a liquid crystal material does not emit light by itself. Accordingly, for example, a planar light source device (backlight) that irradiates a display region of the liquid crystal display device with light is disposed behind the display region made up of a plurality of pixels. In a color liquid crystal display device, one pixel is formed of three types of sub-pixels including, for example, a red light emitting sub-pixel, a green light emitting sub-pixel, and a blue light emitting sub-pixel. An image is displayed by controlling a liquid crystal cell forming each pixel or each sub-pixel to operate as one type of light shutter (light valve), that is, by controlling light transmittance (numerical aperture) of each pixel or each sub-pixel and thereby controlling light transmittance of illumination light (for example, white light) emitted from the planar light source device.

In the past, a planar light source device employed in a liquid crystal display illuminates the entire display region uniformly at constant brightness. This configuration, however, causes deterioration of a moving picture display quality resulting from edge blurring. To overcome this inconvenience, there has been proposed a planar light source device formed of a plurality of planar light source units and controlled in such a manner that the respective planar light source units light on sequentially in synchronization with the completion of scans on portions of the liquid crystal display device corresponding to the respective planar light source units. For example, JP-A-2000-321551 describes a liquid crystal display provided with such a planar light source device. According to this liquid crystal display, blurring of a moving picture in an active matrix liquid crystal display device can be lessened. The moving picture display performance can be thus improved.

SUMMARY OF THE INVENTION

When a period to display the screen in black (black display period) is inserted between video display periods, a frame image and the following frame image are completely isolated in terms of time. Such isolation further enhances the moving image display characteristic. However, for example, given that the frame rate is 60 Hz in the absence of a black display period, then, in order to insert a black display period, it becomes necessary to drive the liquid crystal display in such a manner that a total of 120 video display periods and black display periods are present in one second. Further, for example, in order to set the video display periods and the black display periods to be of substantially the same length, in the case of a liquid crystal display provided with a planar light source device (hereinafter, referred to as the synchronous-type planar light source device for ease of description) controlled in such a manner that the respective light source units light on sequentially in synchronization with the completion of scans in portions of the liquid crystal display device corresponding to the respective planar light source units, it becomes necessary to scan the liquid crystal display device in about half the frame period of 1/60 (second). In addition, in a case where the liquid crystal display is used to alternately display right-eye images and left-eye images for a 3D image display, the actual frame period is shortened to half, that is, 1/120 (second). It therefore becomes necessary to drive the liquid crystal display in such a manner that a total of 240 video display periods and black display periods are present in one second. The liquid crystal display provided with the synchronous-type planar light source device has to shorten a scan period of the liquid crystal display device in order to insert a black display period. This raises a problem that a timing margin in a scan is reduced.

Thus, it is desirable to provide a liquid crystal display and a driving method of a liquid crystal display capable of lowering a degree of reduction of a timing margin in a scan on the liquid crystal display device caused by insertion of a black display period.

According to an embodiment of the present invention, there is provided a liquid crystal display including a transmissive liquid crystal display device having a display region made up of pixels arrayed in a matrix fashion, a planar light source device formed of a plurality of planar light source units corresponding to respective display region units on an assumption that the display region is divided into a plurality of the display region units and configured in such a manner that each planar light source unit irradiates a corresponding display region unit with light, and a drive circuit driving the liquid crystal display device and the planar light source device.

The liquid crystal display device is scanned line-sequentially and hence the pixels making up each display region unit are scanned line-sequentially. A planar light source unit corresponding to a display region unit is held in a luminous state over a predetermined period since a line-sequential scan on the display region unit has been completed. A luminous period of a planar light source unit corresponding to a display region unit on which the line-sequential scan is completed last in a given frame period and a luminous period of a planar light source unit corresponding to a display region unit on which the line-sequential scan is completed first in a frame period following the given frame period are set so as not to overlap each other. A wait time since the line-sequential scan on a display region unit has been completed until a planar light source unit corresponding to the display region unit changes to a luminous state is set in such a manner that a wait time in a display region unit on which the line-sequential scan is completed first and a wait time in a display region unit on which the line-sequential scan is completed last in one frame period become longest and shortest, respectively. Wait times in display region units positioned between the display region unit on which the line-sequential scan is completed first and the display region unit on which the line-sequential scan is completed last in the one frame are set so as to decrease in descending order in which the scan is completed.

According to another embodiment of the present invention, there is provided a driving method of a liquid crystal display including the steps of performing, with the use of the liquid crystal display described above, processing to scan the liquid crystal display device line-sequentially and hence to scan the pixels making up each display region unit line-sequentially, and performing processing to hold a planar light source unit corresponding to a display region unit in a luminous state over a predetermined period since a line-sequential scan on the display region unit has been completed.

A luminous period of a planar light source unit corresponding to a display region unit on which the line-sequential scan is completed last in a given frame period and a luminous period of a planar light source unit corresponding to a display region unit on which the line-sequential scan is completed first in a frame period following the given frame period are set so as not to overlap each other. A wait time since the line-sequential scan on a display region unit has been completed until a planar light source unit corresponding to the display region unit changes to a luminous state is set in such a manner that a wait time in a display region unit on which the line-sequential scan is completed first and a wait time in a display region unit on which the line-sequential scan is completed last in one frame period become longest and shortest, respectively. Wait times in display region units positioned between the display region unit on which the line-sequential scan is completed first and the display region unit on which the line-sequential scan is completed last in the one frame are set so as to decrease in descending order in which the scan is completed.

With the liquid crystal display and the driving method of a liquid crystal display according to the embodiments of the present invention, a wait time since the line-sequential scan on a display region unit has been completed until a planar light source unit corresponding to this display region unit changes to a luminous state is set in such a manner that a wait time in a display region unit on which the line-sequential scan is completed first becomes the longest and a wait time in a display region unit on which the line-sequential scan is completed last becomes the shortest. Also, wait times in display region units positioned between the display region unit on which the line-sequential scan is completed first and the display region unit on which the line-sequential scan is completed last are set so as to decrease in descending order in which the scan is completed. Accordingly, the scan period of the liquid crystal display device can be set longer than in a liquid crystal display provided with a synchronous-type planar light source device and by a driving method using this liquid crystal display.

BRIEF DESCRIPTION OF THE DRAWINGS

FIG. 8A through FIG. 8D are schematic views showing operating states of a planar light source device and a color liquid crystal display device forming a liquid crystal display according to the reference example;

FIG. 9A through FIG. 9D are schematic views continuing from FIG. 8D to show the operating states of the planar light source device and the color liquid crystal display device forming the liquid crystal display according to the reference example;

FIG. 10A through FIG. 10C are schematic views continuing from FIG. 9D to show the operating states of the planar light source device and the color liquid crystal display device forming the liquid crystal display according to the reference example;

FIG. 11A through FIG. 11D are schematic views showing operating states of a planar light source device and a color liquid crystal display device forming a liquid crystal display according to an embodiment of the present invention;

FIG. 12A through FIG. 12D are schematic views continuing from FIG. 11D to show the operating states of the planar light source device and the color liquid crystal display device forming the liquid crystal display according to the embodiment of the present invention;

FIG. 13A through FIG. 13C are schematic views continuing from FIG. 12D to show the operating states of the planar light source device and the color liquid crystal display device forming the liquid crystal display according to the embodiment of the present invention.

DESCRIPTION OF THE PREFERRED EMBODIMENTS

Figure 1:
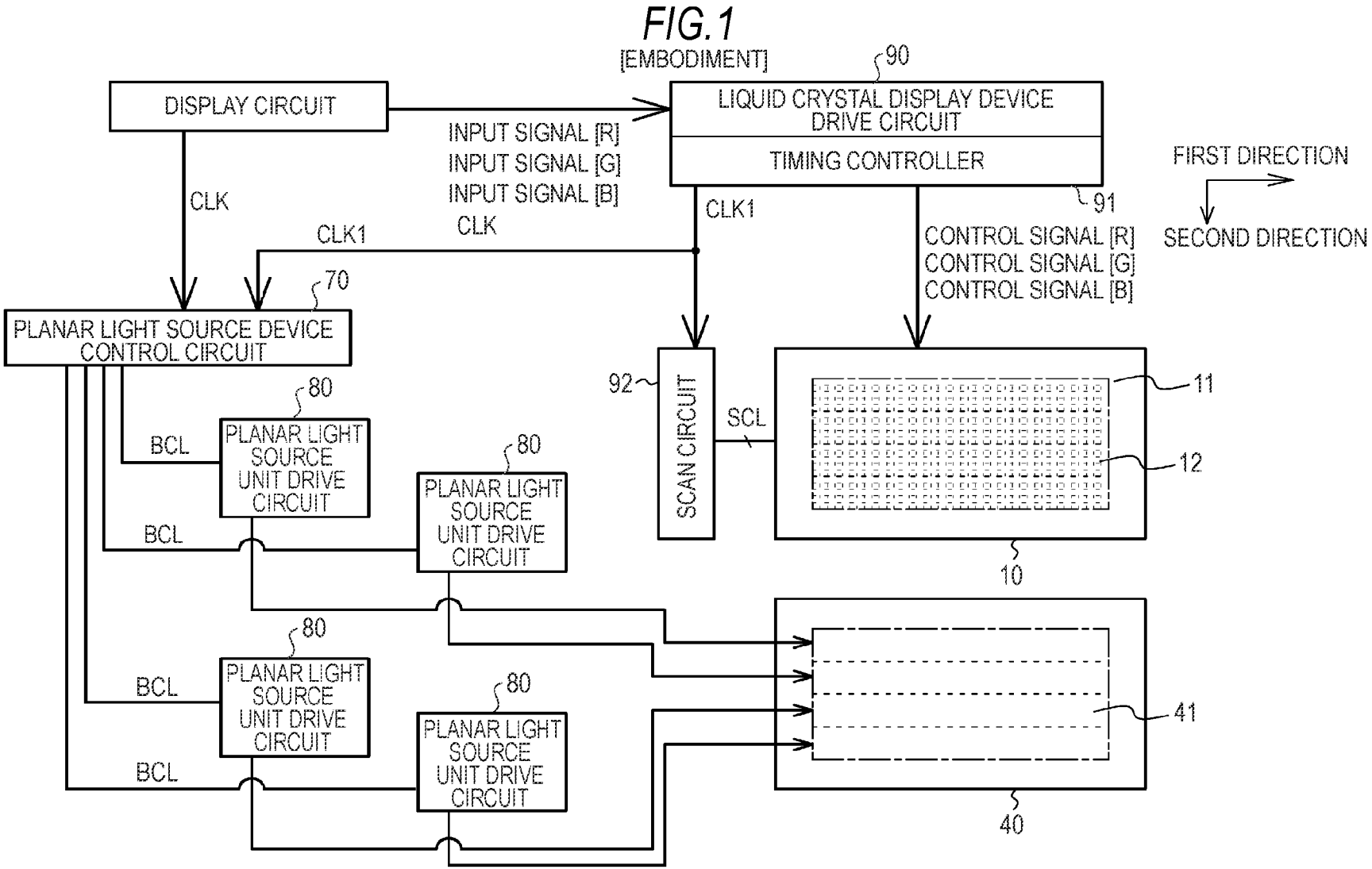
FIG. 1 is a conceptual view of a liquid crystal display provided with a color liquid crystal display device, a planar light source device, and a drive circuit.

Hereinafter, a liquid crystal display and a driving method of a liquid crystal display according to embodiments of the invention will be described with reference to the drawings in the following order.

1. Detailed description of the present invention
2. Brief description of liquid crystal display employed in embodiment of the present invention
3. Embodiment of the present invention

DETAILED DESCRIPTION OF THE PRESENT INVENTION

For a liquid crystal display and a driving method of a liquid crystal display according to embodiments of the present invention, it can be configured in such a manner that a period between the beginning of a luminous period of a planar light source unit corresponding to a display region unit on which a line-sequential scan has been completed first in a given frame period and the end of a luminous period of a planar light source unit corresponding to a display region unit on which a line-sequential scan has been completed last in this frame period forms a video display period. Also, it can be configured in such a manner that a period between the end of a luminous period of a planar light source unit corresponding to a display region unit on which a line-sequential scan has been completed last in a given frame period and the beginning of a luminous period of a planar light source unit corresponding to a display area unit on which a line-sequential scan has been completed first in a frame period following this frame period forms a black display period.

Basically, virtual display region units of the liquid crystal display device are units divided so that each is made up of pixels in a predetermined number of rows and aligned in the scan direction. In a case where the liquid crystal display device has $M_0 \times N_0$ pixels arrayed in a 2D matrix fashion and pixels in the first through $N_0$'th rows are scanned sequentially, the minimum value and the maximum value of the virtual display region units are 2 and $N_0$, respectively. The number of virtual display region units is basically determined according to the design of the planar light source units. The number of rows of pixels in the display region units can be either constant or different.

A light source for the planar light source units forming the planar light source device can be, for example, a light emitting diode (LED) or it can also be an electroluminescent (EL) device, a cold cathode field emission display (FED), a plasma display, and so forth. The light source may be a cold-cathode ray fluorescent lamp or a normal lamp as long as no trouble occurs in the control on a luminous state and non-luminous state. In a case where the light source is formed of a light emitting diode, white light can be obtained by forming the light source from a set of a red light emitting diode emitting red light having, for example, a wavelength of 640 nm, a green light emitting diode emitting green light having, for example, a wavelength of 530 nm, and a blue light emitting diode emitting blue light having, for example, a wavelength of 450 nm. Alternatively, white light can be obtained by light emission from a white light emitting diode (for example, alight emitting diode that emits white light by combining an ultraviolet or blue light emitting diode and phosphor particles). Further, light emitting diodes emitting light in a fourth color, a fifth color, and so on besides red, green, and blue light may be provided.

In a case where the light source is formed of light emitting diodes, a plurality of red light emitting diodes emitting red light, a plurality of green light emitting diodes emitting green light, and a plurality of blue light emitting diodes emitting blue light are disposed and arrayed in the planar light source units. To be more concrete, the light source can be formed of light emitting diode units including a combination of one red light emitting diode, one green light emitting diode, and one blue light emitting diode, a combination of one red light emitting diode, two green light emitting diodes, and one blue light emitting diode, a combination of two red light emitting diodes, two green light emitting diodes, and one blue light emitting diode, and so forth.

A light emitting diode can have a so-called face-up structure or a flip-chip structure. In other words, a light emitting diode is formed of a substrate and a luminous layer formed on the substrate. The light emitting diode may have either a structure in which light exits from the luminous layer to the outside or a structure in which light from the luminous layer exits to the outside by passing through the substrate. To be more concrete, the light emitting diode (LED) has a laminated structure including, for example, a first clad layer formed of a compound semiconductor layer having a first conductivity type (for example, n type) formed on the substrate, an active layer formed on the first clad layer, and a second clad layer formed of a compound semiconductor layer having a second conductivity type (for example, p type) formed on the active layer. The light emitting diode also includes a first electrode electrically connected to the first clad layer and a second electrode electrically connected to the second clad layer. Layers forming the light emitting diode are dependent on emission wavelengths and can be made of known compound semiconductor materials. In order to increase a light extraction efficiency from the light emitting diode, it is preferable to attach a semispherical resin material of a constant size to a light exiting portion of the light emitting diode. In a case where it is desired to emit light in a particular direction, for example, a 2D direction light-exiting structure by which light chiefly exits in a horizontal direction may be provided.

The planar light source device may be configured to further include a light diffusion plate and an optical functional sheet group including a diffusion sheet, a prism sheet, and a polarization conversion sheet as well as a reflection sheet. The optical functional sheet group may be formed of various types of sheets that are spaced apart from one another or laminated and formed into one integral body. Examples of a material of the light diffusion plate include polymethylmethacrylate (PMMA) and polycarbonate resin (PC). The light diffusion plate and the optical functional sheet group are disposed between the planar light source device and the liquid crystal display device.

A transmissive liquid crystal display device is formed, for example, of a front panel provided with a transparent first electrode, a rear panel provided with a transparent second electrode, and a liquid crystal material filled in a space between the front panel and the rear panel. The liquid crystal display device can be either a monochrome liquid crystal display device or a color liquid crystal display device.

To be more concrete, the front panel includes a first substrate formed of a glass substrate or a silicon substrate, a transparent first electrode (referred to also as a common electrode and made, for example, of ITO) provided on the outer surface of the first substrate, and a polarization film provided on the outer surface of the first substrate. In a transmissive color liquid crystal display device, a color filter coated with an overcoat layer made of acrylic resin or epoxy resin is further provided on the inner surface of the first substrate. Examples of the layout pattern of the color filter include a delta arrangement, a stripe arrangement, a diagonal arrangement, and a rectangle arrangement. The front panel is configured in such a manner that the transparent first electrode is formed on the overcoat layer. It should be noted that an oriented film is formed on the transparent first electrode. Meanwhile, to be more concrete, the rear panel includes, for example, a second substrate formed of a glass substrate or a silicon substrate, switching elements formed on the inner surface of the second substrate, transparent second electrodes (referred to also as the pixel electrodes and made, for example, of ITO) controlled to be conductive and nonconductive by the corresponding switching elements, and a polarization film provided on the outer surface of the second substrate. An oriented film is formed on the entire surface including the transparent second electrodes. Various members and the liquid crystal material forming the liquid crystal display device including a transmissive color liquid crystal display device can be known members and materials. Examples of the switching elements include but not limited to a 3-terminal element, such as an MOSFET and a thin film transistor (TFT) formed on a single-crystal silicon semiconductor substrate, and a 2-terminal element, such as an MIM element, a varistor element, and a diode.

An overlapping region of the transparent first electrode and each transparent second electrode including a liquid crystal cell corresponds to a pixel or a sub-pixel. In a transmissive color liquid crystal display device, one pixel includes a red light emitting sub-pixel (hereinafter, occasionally referred to as the sub-pixel [R]) that is formed of a combination of the region specified above and a color filter transmitting red, a green light emitting sub-pixel (hereinafter, occasionally referred to as the sub-pixel [G]) that is formed of a combination of the region specified above and a color filter transmitting green, and a blue light emitting sub-pixel (hereinafter, occasionally referred to as the sub-pixel [B]) that is formed of a combination of the region specified above and a color filter transmitting blue. A layout pattern of the sub-pixel [R], the sub-pixel [G], and the sub-pixel [B] coincides with the layout pattern of the color filter described above. It should be appreciated that a pixel is not necessarily formed of a set of three types of sub-pixels [R, G, B] including the sub-pixel [R], the sub-pixel [G], and the sub-pixel [B]. For example, a pixel may be formed of a set including these three types of sub-pixels [R, G, B] and an addition sub-pixel of one or more than one type (for example, a set including an additional sub-pixel emitting white light in order to enhance the luminance, a set including an additional sub-pixel emitting light of a complimentary color in order to broaden the color reproduction range, a set including an additional sub-pixel emitting yellow light in order to broaden the color reproduction range, or a set including additional sub-pixels emitting yellow and cyan light in order to broaden the color reproduction range).

Herein, let ($M_0$, $N_0$) be the number of pixels, $M_0 \times N_0$, arrayed in a 2D matrix fashion, then the value of ($M_0$, $N_0$) can be some types of resolution for image display, and more concretely, VGA(640, 480), S-VGA(800, 600), XGA(1024, 768), APRC(1152, 900), S-XGA(1280, 1024), U-XGA (1600, 1200), HD-TV(1920, 1080), and Q-XGA(2048, 1536) as well as (1920, 1035), (720, 480), and (1280, 960). The number of pixels, however, is not limited to the values specified above.

A drive circuit driving the liquid crystal display device and the planar light source device includes, for example, a planar light source unit drive circuit formed of a known circuit, such as a constant current circuit, a planar light source device control circuit formed of a known circuit, such as a logic circuit, and a liquid crystal display device drive circuit formed of a known circuit, such as a timing controller.

A time over which image information necessary to form one image is sent in the form of an electric signal is a frame period (unit: seconds) and the inverse of the frame period is a frame frequency (frame rate). It should be noted that a frame period contains a wait time since the image information necessary to form one image has been sent in the form of an electric signal until an electric signal to display the following image is sent.

Brief Description of Liquid Crystal Display Employed in Embodiment of the Present Invention Hereinafter, a liquid crystal display and a driving method of a liquid crystal display according to embodiments of the present invention will be described with reference to the drawings. Prior to the description, a transmissive liquid crystal display device (to be more concrete, a transmissive color liquid crystal display device) and a planar light source device suitably employed in an embodiment of the present invention will be described briefly with reference to FIG. 1, FIG. 2A, FIG. 2B, FIG. 3, and FIG. 4.

As is shown in the conceptual view of FIG. 1, a liquid crystal display includes:

(A) a transmissive color liquid crystal display device 10 having a display region 11 made up of pixels arrayed in a matrix fashion;

(B) a planar light source device 40 formed of a plurality of planar light source units 41 corresponding to respective display region units 12 on the assumption that the display region 11 is divided into a plurality of the display region units 12 and configured in such a manner that each planar light source unit 41 irradiates a corresponding display region unit 12 with light; and (C) a drive circuit driving the liquid crystal display device 10 and the planar light source device 40.

As is shown in the conceptual view of FIG. 1, the transmissive color liquid display device 10 includes the display region 11 in which a total of $M_0 \times N_0$ pixels are arrayed in a 2D matrix fashion, $M_0$ pixels along a first direction and $N_0$ pixels along a second direction. Herein, assume that the display region 11 is divided into a plurality (for example, P) virtual display region units 12. For example, when the number of pixels, $M_0 \times N_0$, arrayed in a 2D matrix fashion and satisfying the VGA standards as resolution for image display is expressed as ($M_0$, $N_0$), then the number of pixels is expressed as (640, 480). Also, the display region 11 made up pixels arrayed in a 2D matrix fashion (a region encircled by an alternate long and short dashed line in FIG. 1) is divided into a plurality (for example, P) of virtual display region units 12 (boundaries are indicated by a dotted line). From a design viewpoint, P can take a value from 2 to $N_0$. In an example shown in FIG. 1, P takes a value of 4. Each display region unit 12 is made up of a plurality of pixels. Each pixel is formed of a set of a plurality of sub-pixels each emitting light in a different color. To be more concrete, each pixel is formed of three types of sub-pixels including a red light emitting sub-pixel (sub-pixel [R]), a green light emitting sub-pixel (sub-pixel [G]), and a blue light emitting sub-pixel (sub-pixel [B]). The transmissive color liquid crystal display device 10 is driven line-sequentially. To be more concrete, the color liquid crystal display device 10 has scan electrodes (extending along the first direction) and data electrodes (extending along the second direction) intersecting in a matrix fashion. One screen is formed by inputting a scan signal into the scan electrodes to choose and scan the scan electrodes so that an image is displayed according to a control signal (basically, a signal based on an input signal) inputted into the data electrodes.

The liquid crystal display device 10 is scanned line-sequentially and hence the pixels forming each display region unit 12 are scanned line-sequentially. In the following description, assume that a scan is performed sequentially toward the second direction. As will be described below, the planar light source unit 41 corresponding to a display region unit 12 is held in a luminous state over a predetermined time since the line-sequential scan on this display region unit 12 has been completed. A driving method of the liquid crystal display according to an embodiment of the present invention includes the steps of performing processing to scan the liquid crystal display device 10 line-sequentially and hence to scan the pixels forming each display region unit 12 line-sequentially and performing processing to hold a planar light source unit 41 corresponding to a display region unit 12 in a luminous state over a predetermined period since the line-sequential scan on this display region unit 12 has been completed.

Figure 4:
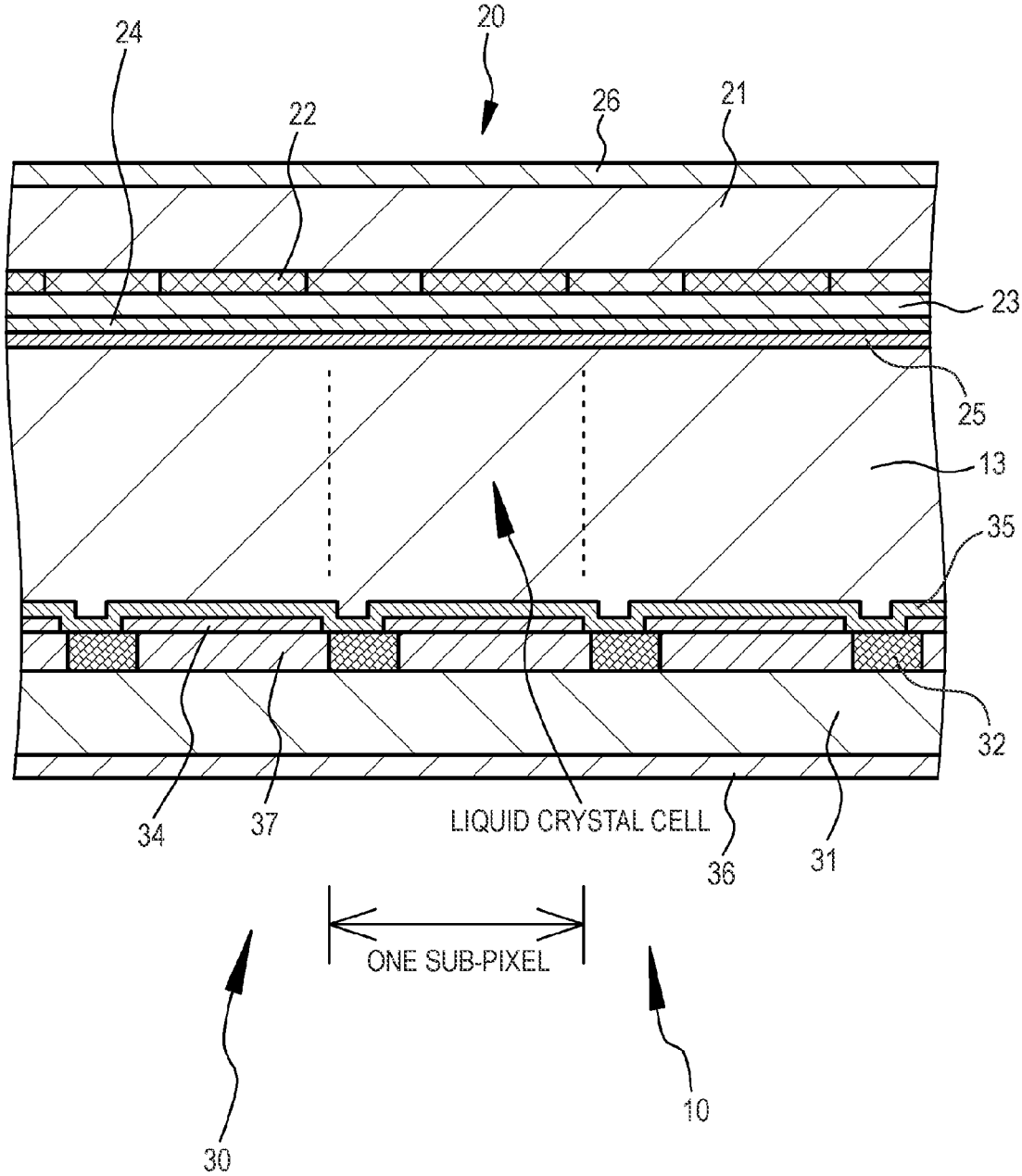
FIG. 4 is a schematic partial cross section of a color liquid crystal display device.

As is shown in a schematic partial cross section of FIG. 4, the color liquid crystal display device 10 is formed of a front panel 20 provided with a transparent first electrode 24, a rear panel 30 provided with transparent second electrodes 34, and a liquid crystal material 13 filled in a space between the front panel 20 and the rear panel 30.

The front panel 20 includes, for example, a first substrate 21 formed of a glass substrate, and a polarization film 26 provided on the outer surface of the first substrate 21. A color filter 22 coated with an overcoat layer 23 made of acrylic resin or epoxy resin is provided on the inner surface of the first substrate 21. The transparent first electrode (referred to also as the common electrode and made, for example, of ITO) 24 is formed on the overcoat layer 23. An oriented film 25 is formed on the transparent first electrode 24. Meanwhile, to be more concrete, the rear panel 30 includes, for example, a second substrate 31 formed of a glass substrate, switching elements (to be more concrete, thin film transistors (TFTs)) 32 formed on the inner surface of the second substrate 31, transparent second electrodes (referred to also as the pixel electrodes and made, for example, of ITO) 34 controlled to be conductive and non-conductive by the corresponding switching elements 32, and a polarization film 36 provided on the outer surface of the second substrate 31. An oriented film is provided across the entire surface including the transparent second electrodes 34. The front panel 20 and the rear panel 30 are jointed to each other at the respective outer peripheral portions via a sealing member (not shown). It should be appreciated that the switching elements 32 are not limited to TFTs and, for example, they may be formed of MIM elements. Reference numeral 37 in the drawing denotes an insulation layer provided between one switching element 32 and another switching element 32.

Various members and the liquid crystal material forming the transmissive color liquid crystal display device can be known members and materials. Accordingly, detailed descriptions are omitted herein.

Figure 2A:
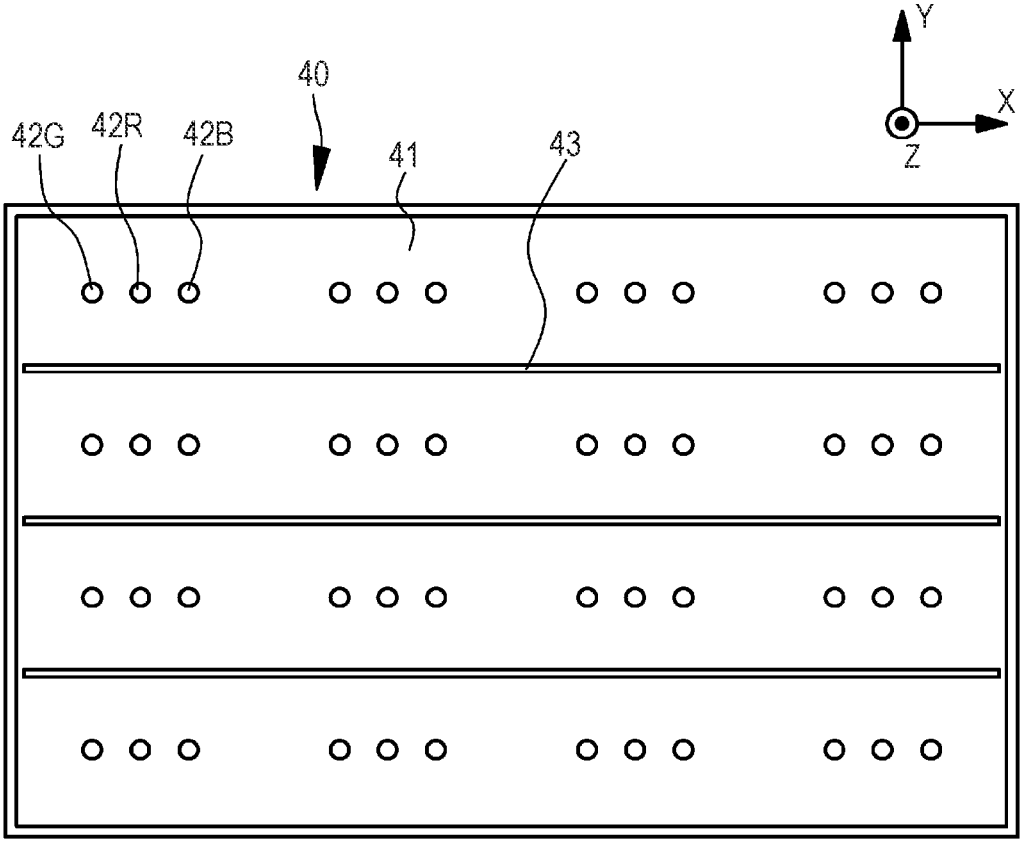
FIG. 2A is a plan view schematically showing a layout and an arrangement of partition walls and light emitting diodes in a planar light source device according to an embodiment of the present invention.
Figure 2B:
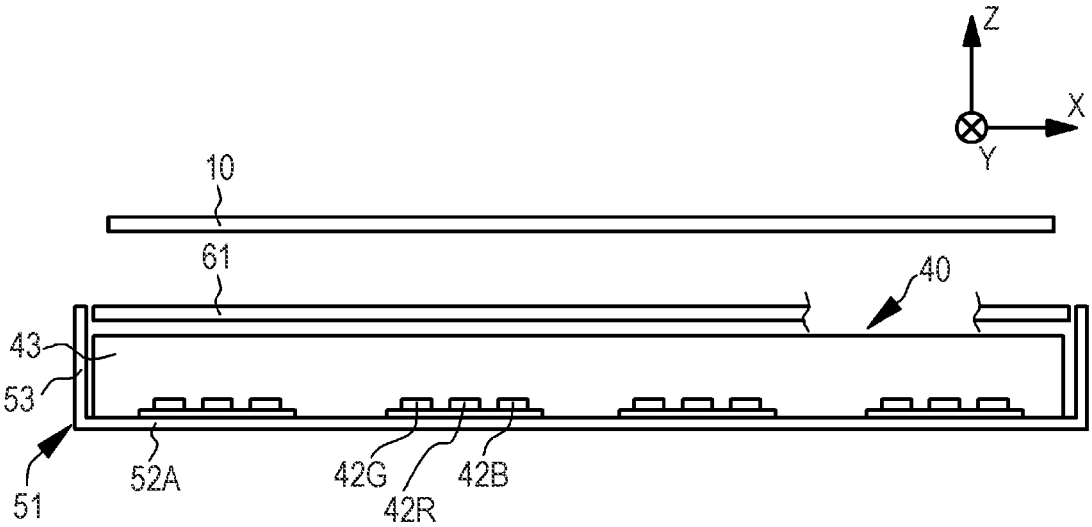
FIG. 2B is a schematic end view of the liquid crystal display according to the embodiment of the present invention.
Figure 3:
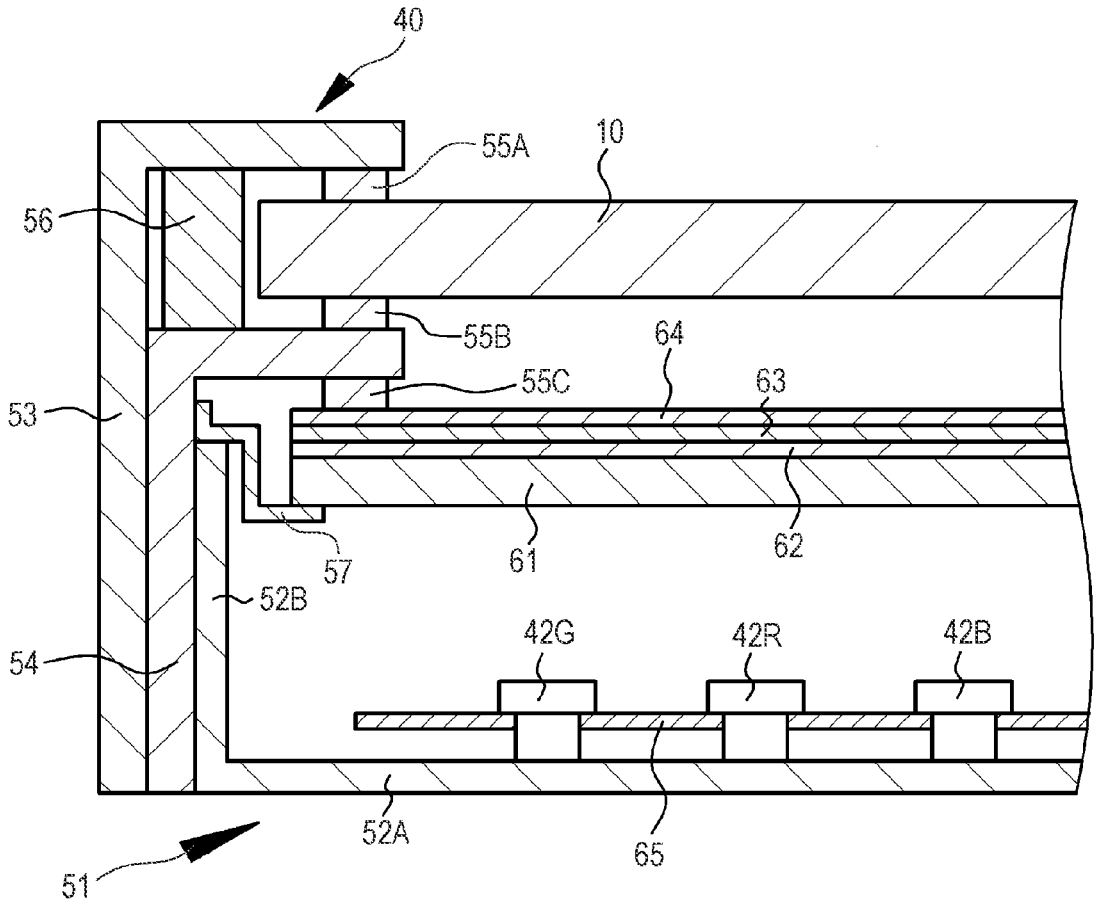
FIG. 3 is a schematic partial cross section of the liquid crystal display.

A direct planar light source device (backlight) 40 includes a plurality (P) of planar light source units 41 corresponding to a plurality of respective virtual display region units 12. Each planar light source unit 41 illuminates the display region unit 12 corresponding to the planar light source unit 41 from behind. Light sources provided to the planar light source unit 41 are controlled individually. Although the planar light source device 40 is positioned under the color liquid crystal display device 10, the color liquid crystal display device 10 and the planar light source device 40 are shown separately in FIG. 1. The layout and the arrangement of partition walls and light emitting diodes in the planar light source device 40 are schematically shown in a plan view of FIG. 2A. A schematic end view of the liquid crystal display according to the embodiment of the present invention is shown in FIG. 2B. FIG. 2B shows major members. In the drawing, however, the hatching on a housing 51, the color liquid crystal display device 10, a light diffusion plate 61, and so forth is omitted and a part of a diffusion plate 20 is notched. Further, a schematic partial cross section of the liquid crystal display formed of the color liquid crystal display device 10 and the planar light source device 40 is shown in FIG. 3. For ease of illustration, partition walls 43 are omitted in FIG. 3. Light sources are formed of light emitting diodes 42 (42R, 42G, and 42B) driven, for example, by the pulse width modulation (PWM) control method.

As is shown in a schematic partial cross section of the liquid crystal display of FIG. 3, the planar light source device 40 is formed of the housing 51 provided with an outer frame 53 and an inner frame 54. The end portion of the transmissive color liquid crystal display device 10 is held by being sandwiched between the outer frame 53 and the inner frame 54 via spacers 55A and 55B. A guide member 56 is disposed between the outer frame 53 and the inner frame 54. It is therefore structured in such a manner that the color liquid crystal display device 10 sandwiched between the outer frame 53 and the inner frame 54 will not undergo displacement. The light diffusion plate 61 is attached to the inner frame 54 via a spacer 55C and a bracket member 57 at the top inside the housing 51. An optical functional sheet group including a diffusion sheet 62, a prism sheet 63, and a polarization conversion sheet 64 is laminated on the light diffusion plate 61.

A reflection sheet 65 is provided at the bottom inside the housing 51. Herein, the reflection sheet 65 is disposed so that the reflection surface opposes the light diffusion plate 61 and it is attached to the bottom surface 52A of the housing 51 via an unillustrated attachment member. The reflection sheet 65 is formed, for example, of a silver sensitizing reflection film having a structure in which a silver reflection film, a low refractive film, and a high refractive film are sequentially laminated on a sheet base material. The reflection sheet 65 reflects light emitted from a plurality of light emitting diodes 42 (light sources 42) and light reflected on the side surface 52B of the housing 51 or the partition walls 43 shown in FIG. 2A and FIG. 2B. When configured in this manner, red light, green light, and blue light emitted, respectively, from a plurality of red light emitting diodes 42R (light sources 42R) emitting red light, a plurality of green light emitting diodes 42G (light sources 42G) emitting green light, a plurality of blue light emitting diode 42B (light sources 42B) emitting blue light are mixed. It thus becomes possible to obtain white light with high chromatic purity as illumination light. This illumination light passes through the light diffusion plate 61 and the optical functional sheet group including the diffusion sheet 62, the prism sheet 63, and the polarization conversion sheet 64 and illuminates the color liquid display device 10 from behind.

Regarding the arrangement of the light emitting diodes 42R, 42G, and 42B, for example, it may be configured in such a manner that a light emitting diode unit is formed of a set of a red light emitting diode 42R emitting red light (for example, wavelength of 640 nm), a green light emitting diode 42G emitting green light (for example, wavelength of 530 nm), and a blue light emitting diode 42B emitting blue light (for example, wavelength of 450 nm) and a plurality of light emitting diode units are arrayed in a horizontal direction and a vertical direction. In an example shown in FIG. 2A and FIG. 2B, four light emitting diode units are disposed in one planar light source unit 41.

One planar light source unit 41 and another planar light source unit 41 forming the planar light source device 40 are partitioned by the partition wall 43. In an example shown in FIG. 2A and FIG. 2B, the planar light source units 41 are surrounded by the side surfaces of the housing 51 and the partition walls 43. To be more concrete, there are planar light source units 41 each of which is surrounded by two partition walls 43 and two side surfaces 52B of the housing 51 and planar light source units 41 each of which is surrounded by one partition wall 43 and three side surfaces 52B of the housing 51. The partition walls 43 are attached to the bottom surface 52A of the housing 51 via unillustrated attachment members.

As is shown in FIG. 1, a drive circuit that drives the planar light source device 40 and the color liquid crystal display device 10 according to an input signal and a clock signal from the outside (display circuit) includes a planar light source device control circuit 70 and planar light source unit drive circuits 80 that control emission and non-emission of light from the red light emitting diodes 42R, the green light emitting diodes 42G, and the blue light emitting diodes 42B forming the planar light source device 40 as well as a liquid crystal display device drive circuit 90. The planar light source device control circuit 70 is formed of a logic circuit and a shift register circuit. Meanwhile, each planar light source unit drive circuit 80 is formed, for example, of a light emitting diode drive power supply (constant current source). Known circuits or the like are available as circuits forming the planar light source device control circuit 70 and the planar light source unit drive circuits 80.

The liquid crystal display device drive circuit 90 driving the color liquid crystal display device 10 is formed of known circuits, such as a timing controller 91, a scan circuit 92, and a source driver (not shown). The timing controller 91 generates a first clock signal CLK1 on the basis of a clock signal CLK from the outside (display circuit) and supplies the scan circuit 92 with the first clock signal clock CLK1. The scan circuit 92 scans the scan electrodes SCL according to the first clock signal CLK1 and drives the switching elements 32 formed of TFTs constituting the liquid crystal cells. The source driver applies a signal at a voltage corresponding to values of control signals [R, G, B] described below to unillustrated data electrodes.

The planar light source device control circuit 70 generates a second clock signal CLK2 on the basis of the clock signal CLK from the outside (display circuit) and the first clock signal CLK1 from the timing controller 91. The sequentially shifted second clock signal CLK2 is applied to respective control lines BCL. In the following description, assume that each planar light source unit 41 changes to a luminous state when the corresponding control line BCL is at a high level and each planar light source unit 41 changes to a non-luminous state when the corresponding control line BCL is at a low level.

The display region 11 made up of pixels arrayed in a 2D matrix fashion is divided into P display region units 12. By describing this state using rows and columns, it can be said that the display region 11 is divided into display region units arrayed in P rows and one column.

Each display region unit 12 is made up of a plurality ($M_0 \times N$) of pixels. By describing this state using rows and columns, it can be said that each display region unit 12 is formed of pixels arrayed in N rows and $M_0$ columns. In a case where the display region 11 is divided equally, it is basically expressed as $N=N_0/P$. In a case where there is a surplus, the surplus is included in any display region unit 12.

A red light emitting sub-pixel (sub-pixel [R]), a green light emitting sub-pixel (sub-pixel [G]), and a blue light emitting sub-pixel (sub-pixel [B]) are collectively referred to as the sub-pixels [R, G, B] in some cases. Also, a control signal for a red light emitting sub-pixel, a control signal for a green light emitting sub-pixel, and a control signal for a blue light emitting sub-pixel inputted into the sub-pixels [R, G, B] in order to control operations of the sub-pixels [R, G, B] (to be more concreted, to control the light transmittances (numerical apertures)) are collectively referred to as the controls signals [R, G, B] in some cases. Further, an input signal for a red light emitting sub-pixel, an input signal for a green light emitting sub-pixel, and an input signal for a blue light emitting sub-pixel inputted into the drive circuit from the outside in order to drive the sub-pixels [R, G, B] forming the display region units are collectively referred to as the input signals [R, G, B] in some cases.

As has been described, each pixel is formed as a set of three types of sub-pixels including a red light emitting sub-pixel (sub-pixel [R]), a green light emitting sub-pixel (sub-pixel [G]), and a blue light emitting sub-pixel (sub-pixel [B]). For example, the luminance of each of the sub-pixels [R, G, B] is controlled (gradation control) by an 8-bit numerical value and luminance has $2^8$ steps from 0 to 255. Each of values $x_R$, $x_G$, and $x_B$ of the input signals [R, G, B] inputted into the liquid crystal display device drive circuit 90 to drive the sub-pixels [R, G, B] in the respective pixels forming each display region unit 12 takes a value in $2^8$ steps. It should be appreciated that an embodiment of the present invention is not limited to this configuration. For example, the control may be performed using 10-bit numerical value in $2^{10}$ steps from 0 to 1023.

A control signal controlling the light transmittance of each pixel is supplied to the pixel from the drive circuit. To be more concrete, control signals [R, G, B] controlling light transmittances of the respective sub-pixels [R, G, B] are supplied to the respective sub-pixels [R, G, B] from the liquid crystal display device drive circuit 90. In other words, the liquid crystal display device drive circuit 90 generates the control signals [R, G, B] from the input signals [R, G, B] inputted therein and the control signals [R, G, B] are supplied (outputted) to the sub-pixels [R, G, B], respectively. For example, in a case where a so-called gamma correction is applied to the values of the input signals, the control signals [R, G, B] are basically supplied to the color liquid crystal display device 10 by a known method as signals at voltages corresponding to the values of the input signals [R, G, B], $x_R$, $x_G$, and $x_B$, raised to the 2.2th power. The switching elements 32 forming the respective sub-pixels are driven according to a scan signal applied to the scan electrodes SCL and the light transmittance (numerical aperture) of each sub-pixel is controlled by applying a desired voltage to the transparent first electrode 24 and the transparent second electrode 34 forming the liquid crystal cell according to the control signals [R, G, B]. Herein, the light transmittances (numerical apertures) of the sub-pixels [R, G, B] become larger as the values of the control signals [R, G, B] become larger.

Hereinafter, an embodiment of the present invention will be described with reference to the drawings.

Embodiment of the Present Invention

In order to clearly define the correspondence, descriptions will be given hereinafter on the assumption that $N_0=20$ is given for $M_0 \times N_0$ representing the number of pixels, the number of each of the display region units 12 and the planar light source units 41 is four, and each display region unit 12 has five rows of pixels. For example, as is shown in FIG. 8 to FIG. 8D described below, four display region units 12 are indicated by reference numerals $\mathbf{12}_1$, $\mathbf{12}_2$, $\mathbf{12}_3$, and $\mathbf{12}_4$ and the planar light source units 41 corresponding to the respective display region units 12 are indicated by reference numerals $\mathbf{41}_1$, $\mathbf{41}_2$, $\mathbf{41}_3$, and $\mathbf{41}_4$.

The scan electrodes SCL corresponding to 20 rows of pixels are indicted by alpha-numerals $SCL_1$ through $SCL_{20}$ in descending order of line-sequential scan. Then, the scan electrodes of five rows of pixels corresponding to the display region unit $\mathbf{12}_1$ are the scan electrode $SCL_1$ through the scan electrode $SCL_5$. The scan electrodes of five rows of pixels corresponding to the display region unit $\mathbf{12}_2$ are the scan electrode $SCL_6$ through the scan electrode $SCL_{10}$. The scan electrodes of five rows of pixels corresponding to the display region unit $\mathbf{12}_3$ are the scan electrode $SCL_{11}$ through the scan electrode $SCL_{15}$. The scan electrodes of five rows of pixels corresponding to the display region unit $\mathbf{12}_4$ are the scan electrode $SCL_{16}$ through the scan electrode $SCL_{20}$. The control lines BCL corresponding to the planar light source units $\mathbf{41}_1$, $\mathbf{41}_2$, $\mathbf{41}_3$, and $\mathbf{41}_4$ are indicated by alpha-numerals $BCL_1$, $BCL_2$, $BCL_3$, and $BCL_4$, respectively.

In each frame period, the line-sequential scan on the display region unit $\mathbf{12}_1$ is completed first, the line-sequential scan on the display region unit $\mathbf{12}_2$ is completed next followed by the display region unit $\mathbf{12}_3$ and the display region unit $\mathbf{12}_4$. In other words, the display region unit 12 on which the line-sequential scan is completed first in a given frame period is the display region unit $\mathbf{12}_1$. Also, the display region unit 12 on which the line-sequential scan is completed last in a given frame period is the display region unit $\mathbf{12}_4$.

Figure 5:
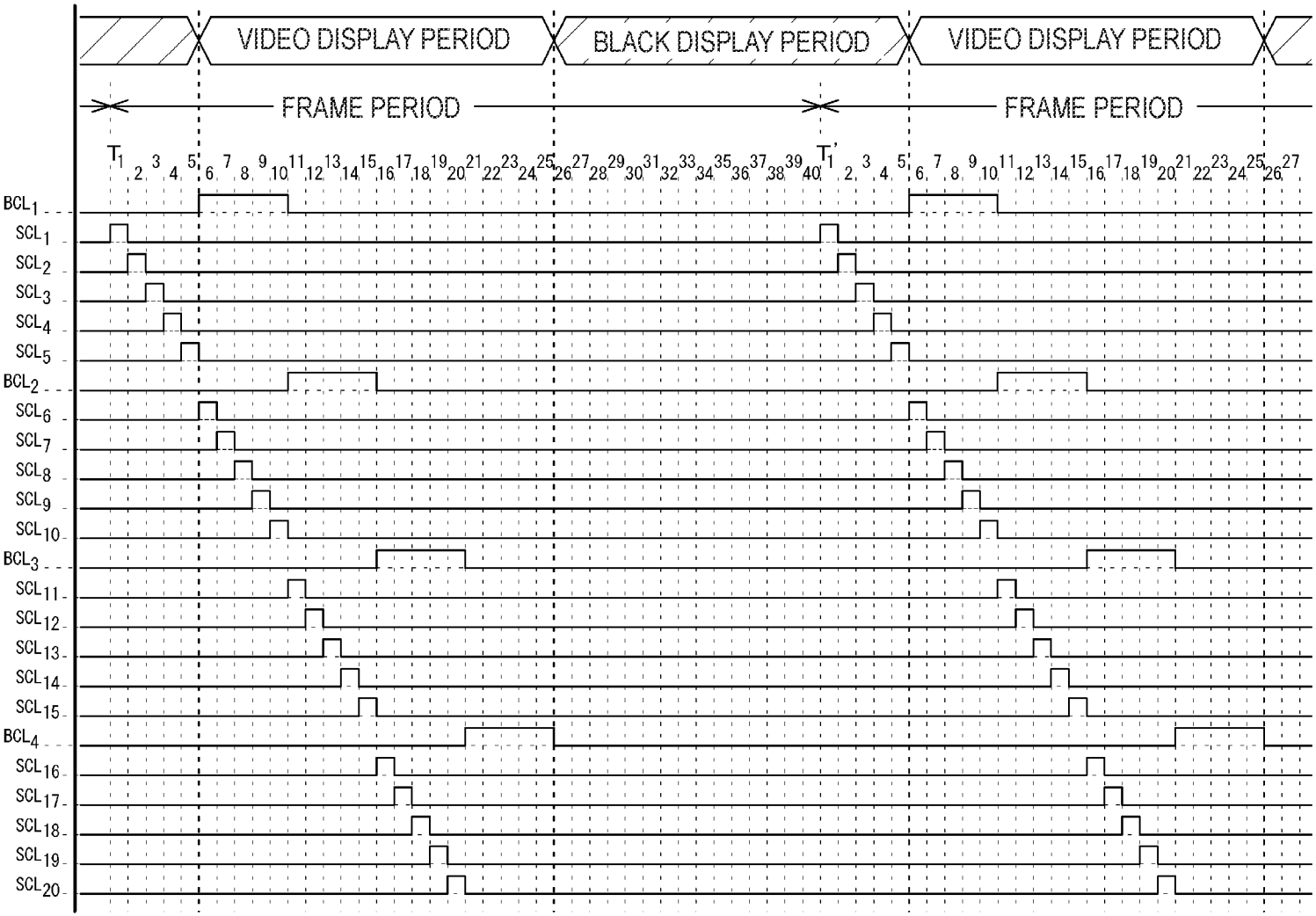
FIG. 5 is a schematic timing chart of an operation of a liquid crystal display according to a reference example.
Figure 6:
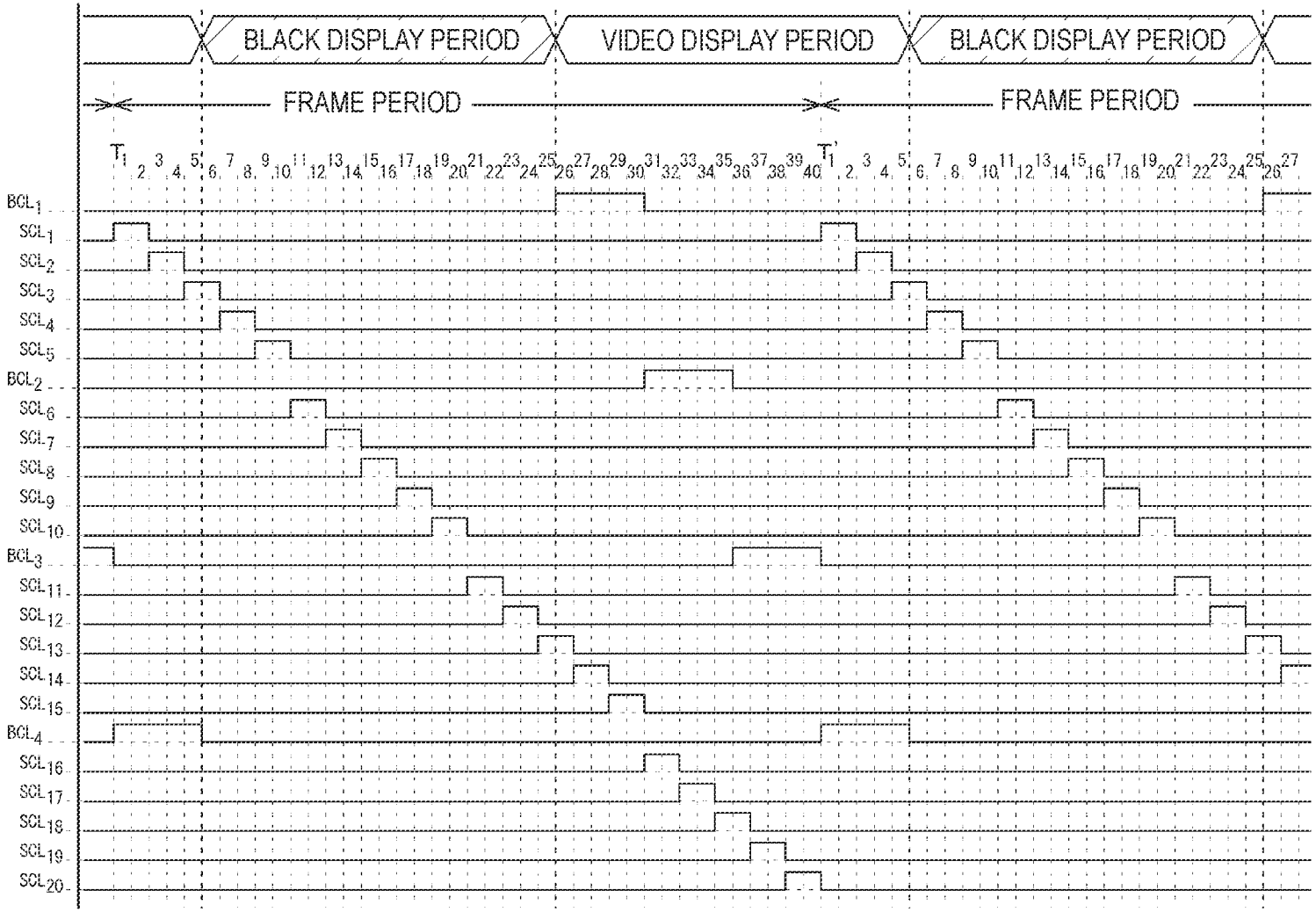
FIG. 6 is a schematic timing chart of an operation of a liquid crystal display according to an embodiment of the present invention.

A timing chart to drive the liquid crystal display according to a reference example is schematically shown in FIG. 5. Also, a timing chart to drive the liquid crystal display according to an embodiment of the present invention is schematically shown in FIG. 6.

Figure 7A:
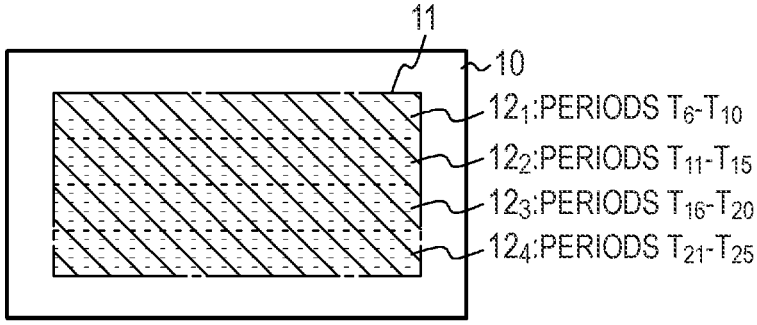
FIG. 7A and FIG. 7B are schematic plan views of display regions used to describe a video display period and a black display period according to the reference example.
Figure 7B:
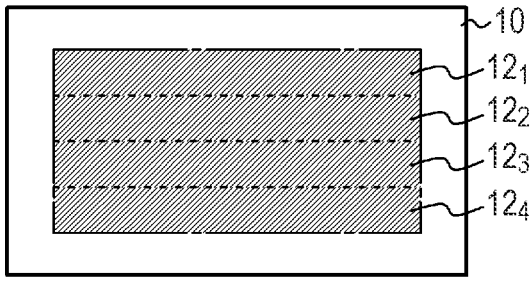
Figure 7C:
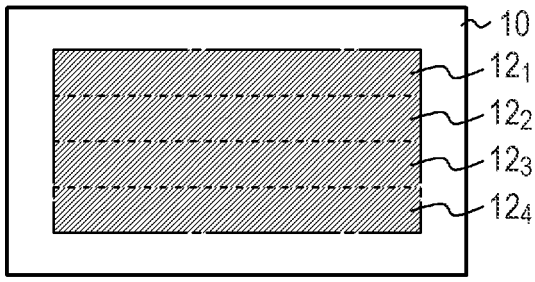
FIG. 7C and FIG. 7D are schematic plan views of display regions used to describe a black display period and a video display period according to an embodiment of the present invention.
Figure 7D:
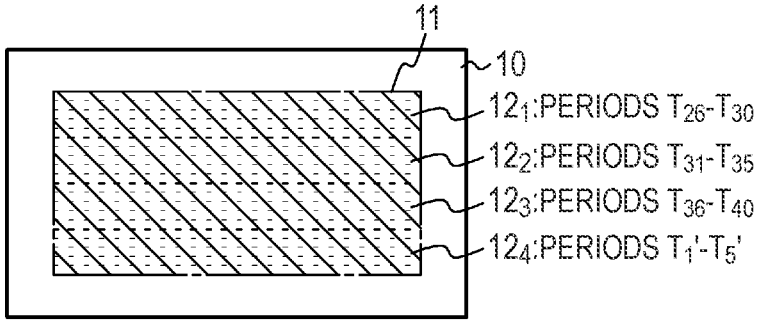

Although it will be described in detail below, in an operation according to the reference example, a period from the beginning of a period $T_6$ to the end of a period $T_{25}$ shown in FIG. 5 forms a video display period (see FIG. 7A) and a period from the beginning of a period $T_{26}$ to the end of a period $T_5'$ included in the following frame period shown in FIG. 5 forms a black display period (see FIG. 7B). By contrast, in an operation according to an embodiment of the present invention, a period from the beginning of a period $T_6$ to the end of a period $T_{25}$ shown in FIG. 6 forms a black display period (see FIG. 7C) and a period from the beginning of a period $T_{26}$ to the end of a period $T_5'$ included in the following frame period shown in FIG. 6 forms a video display period (see FIG. 7D).

For ease of understanding of the present invention, an operation of the liquid crystal display according to the reference example will be described first. Herein, descriptions of the configuration of the liquid crystal display according to the reference example are omitted because it is substantially the same as the configuration of the liquid crystal display described above with reference to FIG. 1 except for operation timing.

A period $T_1$ through a period $T_{40}$ shown in FIG. 5 are respective horizontal scan periods in an operation according to the reference example. In an operation according to the reference example, let $t_0$ be the length of each horizontal scan period. For ease of description, assume that in operations according to both the reference example and an embodiment of the present invention described below, the length of the second clock signal CLK2 is $5t_0$ and the length of a period over which the control lines BCL stay at a high level is also $5t_0$.

In an operation according to the reference example, the respective planar light source units 41 are controlled to sequentially light on in synchronization with the completion of the scan in a portion of the liquid crystal display device 10 corresponding to the planar light source units 41 (to be more concrete, a portion of the display region 11). To be more concrete, according to the reference example, the planar light source units 41 are controlled to start light emission at the same time when the line sequential scan on the corresponding display region units 12 is completed and to hold light emission for a predetermined period. In other words, a wait time since the line-sequential scan on a given display region unit 12 has been completed until the planar light source unit 41 corresponding to this display region unit 12 changes to a luminous state is 0 (nil).

Hereinafter, an operation according to the reference example will be described with reference to FIG. 5, FIG. 8A through FIG. 8D, FIG. 9A through FIG. 9D, and FIG. 10A through FIG. 10C.

Periods $T_1$ through $T_5$ (See FIG. 5 and FIG. 8A)

A new frame period starts from the beginning of the period $T_1$. As is shown in FIG. 5, the control line $BCL_1$ through the control line $BCL_4$ stay at a low level during these periods. As is shown in FIG. 8A, all the planar light source units $\mathbf{41}_1$, $\mathbf{41}_2$, $\mathbf{41}_3$, and $\mathbf{41}_4$ are in a non-luminous state.

In the period $T_1$ through the period $T_5$, the display region unit $\mathbf{12}_1$ is scanned line-sequentially. In other words, the scan electrode $SCL_1$ changes to a high level in the period $T_1$ and the light transmittances of the respective sub-pixels in the first row are controlled according to the control signals [R, G, B]. In the period $T_2$ through the period $T_5$, too, the scan electrode $SCL_2$ through the scan electrode $SCL_5$ are scanned sequentially and the light transmittances of the respective sub-pixels in the second row through the fifth row are controlled in the same manner as above. In FIG. 8A through FIG. 8D, the line-sequentially scanned region is indicated as a newly scanned region. The same can be said in other drawings.

The display region units $\mathbf{12}_2$, $\mathbf{12}_3$, and $\mathbf{12}_4$ hold a state of having been scanned in the preceding frame period. In FIG. 8A through FIG. 8D, regions holding a state of having been scanned in the preceding frame period are indicated as previously scanned regions. The same can be said in other drawings.

As has been described, the display region unit $\mathbf{12}_1$ is scanned line-sequentially in the period $T_1$ through the period $T_5$. All the planar light source units $\mathbf{41}_1$, $\mathbf{41}_2$, $\mathbf{41}_3$, and $\mathbf{41}_4$, however, remain in a non-luminous state. The liquid crystal display is therefore in a black display state.

Periods $T_6$ through $T_{10}$ (See FIG. 5 and FIG. 8B and FIG. 8C)

In the period $T_6$ through the period $T_{10}$, the display region unit $\mathbf{12}_2$ is scanned line-sequentially. Also, a new video display period starts from the beginning of the period $T_6$. The scan electrode $SCL_6$ through the scan electrode $SCL_{10}$ are scanned sequentially and the light transmittances of the respective sub-pixels in the fifth row through the tenth row are controlled in the same manner as above.

Meanwhile, the control line $BCL_1$ changes from a low level to a high level at the beginning of the period $T_6$ and this state is maintained until the period $T_{10}$. The control line $BCL_2$ through the control line $BCL_4$ stay at a low level. The planar light source unit $\mathbf{41}_1$ thus changes to a luminous state whereas the other planar light source units $\mathbf{41}_2$, $\mathbf{41}_3$, and $\mathbf{41}_4$ remain in a non-luminous state. Accordingly, a video corresponding to the light transmittances of the respective sub-pixels in the display region unit $\mathbf{12}_1$ is displayed.

Periods $T_{11}$ through $T_{15}$ (See FIG. 5, FIG. 8D, and FIG. 9A)

In the period $T_{11}$ through the period $T_{15}$, the display region unit $\mathbf{12}_3$ is scanned line-sequentially. The scan electrode $SCL_{11}$ through the scan electrode $SCL_{15}$ are scanned sequentially and the light transmittances of the respective sub-pixels in the eleventh row through the fifteenth row are controlled in the same manner as above.

The control line $BCL_1$ changes from a high level to a low level at the beginning of the period $T_{10}$. The planar light source unit $\mathbf{41}_1$ thus changes to a non-luminous state. Meanwhile, the control line $BCL_2$ changes from a low level to a high level at the beginning of the period $T_{10}$. The planar light source unit $\mathbf{41}_2$ thus changes to a luminous state. The control lines $BCL_3$ and $BCL_4$ stay at a low level. The planar light source units $\mathbf{41}_3$ and $\mathbf{41}_4$ therefore remain in a non-luminous state. Accordingly, a video corresponding to the light transmittances of the respective sub-pixels in the display region unit $\mathbf{12}_2$ is displayed.

Periods $T_{16}$ through $T_{20}$ (See FIG. 5 and FIG. 9B and FIG. 9C)

In the period $T_{16}$ through the period $T_{20}$, the display region unit $\mathbf{12}_4$ is scanned line-sequentially. The scan electrode $SCL_{16}$ through the scan electrode $SCL_{20}$ are scanned sequentially and the light transmittances of the respective sub-pixels in the sixteenth row through the twentieth row are controlled in the same manner as above.

The control line $BCL_2$ changes from a high level to a low level at the beginning of the period $T_{16}$. The planar light source unit $\mathbf{41}_2$ thus changes to a non-luminous state. Meanwhile, the control line $BCL_3$ changes from a low level to a high level at the beginning of the period $T_{16}$. The planar light source unit $\mathbf{41}_3$ thus changes to a luminous state. The control lines $BCL_1$ and $BCL_4$ stay at a low level. The planar light source units $\mathbf{41}_1$ and $\mathbf{41}_4$ therefore remain in a non-luminous state. Accordingly, a video corresponding to the light transmittances of the respective sub-pixels in the display region unit $\mathbf{12}_3$ is displayed.

Periods $T_{21}$ through $T_{25}$ (See FIG. 5, FIG. 9D, and FIG. 10A)

In the period $T_{21}$ through the period $T_{40}$ described below, the scan electrode $SCL_1$ through the scan electrode $SCL_{20}$ are not scanned. The display region units $\mathbf{12}_1$, $\mathbf{12}_2$, $\mathbf{12}_3$, and $\mathbf{12}_4$ therefore hold a previous state.

The control line $BCL_3$ changes from a high level to a low level at the beginning of the period $T_{21}$. The planar light source unit $\mathbf{41}_3$ thus changes to a non-luminous state. Meanwhile, the control line $BCL_4$ changes from a low level to a high level at the beginning of the period $T_{21}$. The planar light source unit $\mathbf{41}_4$ thus changes to a luminous state. The control lines $BCL_1$ and $BCL_2$ stay at a low level. The planar light source units $41_1$ and $41_2$ therefore remain in a non-luminous state. Accordingly, a video corresponding to the light transmittances of the respective sub-pixels in the display region unit $12_4$ is displayed. The end of the period $T_{25}$ corresponds to the end of a video display period.

Periods $T_{26}$ through $T_{40}$ (See FIG. 5 and FIG. 10B)

The control line $BCL_4$ changes from a high level to a low level at the beginning of the period $T_{26}$. The planar light source unit $41_4$ thus changes to a non-luminous state. The control lines $BCL_1$, $BCL_2$, and $BCL_3$ stay at a low level. The planar light source units $41_1$, $41_2$, and $41_3$ therefore remain in a non-luminous state.

Hence, all the planar light source units $41_1$, $41_2$, $41_3$, and $41_4$ are in a non-luminous state. The liquid crystal display thus changes to a black display state. The beginning of the period $T_{26}$ corresponds to the beginning of the black display period.

Periods $T_1'$ through $T_5'$ (See FIG. 5 and FIG. 10C)

A next frame period starts from the beginning of the period $T_1'$. As with the description of the period $T_1$ through the period $T_5$ above, the display region unit $12_1$ is scanned line-sequentially and the light transmittances of the respective sub-pixels in the first row through the fifth row are controlled in the same manner as above. The display region units $12_2$, $12_3$, and $12_4$ hold a state of having been scanned in the preceding frame period. The control line $BCL_1$ through the control line $BCL_4$ stay at a low level. All the planar light source units $41_1$, $41_2$, $41_3$, and $41_4$ therefore remain in a non-luminous state. The liquid crystal display thus maintains a black display state. The end of the period $T_5'$ corresponds to the end of the black display period.

In the period $T_6'$ following the period $T_5'$, as with the descriptions of the period $T_6$ above, the planar light source unit $41_1$ changes to a luminous state and a video display period corresponding to the next frame period starts.

An operation according to the reference example has been described. As is obvious from FIG. 5, in an operation according to the reference example, it is necessary to scan all the scan electrodes SCL in the period $T_1$ through the period $T_{20}$, which is half the period $T_1$ through the period $T_{40}$ forming one field period. By contrast, in an operation according to an embodiment of the present invention, as will be described below, all the period $T_1$ through the period $T_{40}$ can be allocated to periods in which to scan all the scan electrodes SCL.

An operation according to an embodiment of the present invention will now be described. In an embodiment of the present invention, the length of the horizontal scan period is twice ($2t_0$) the length of the horizontal scan period according to the reference example. It should be appreciated, however, that one field period in FIG. 6 is also formed of the period $T_1$ through the period $T_{40}$ as in FIG. 5 for ease of comparison with the reference example. In an embodiment of the present invention, two periods, such as the period $T_1$ and the period $T_2$, together form one horizontal scan period.

In an embodiment of the present embodiment, a wait time since the line-sequential scan on a given display region unit 12 has been completed until the planar light source unit 41 corresponding to this display region unit 12 changes to a luminous state is set in such a manner that the wait time becomes the longest in the display region unit $12_1$ on which the line-sequential scan is completed first in one frame period and the wait time becomes the shortest in the display region unit $12_4$ on which the line-sequential scan is completed last in one frame period.

In other words, as is shown in FIG. 6, the wait time in the display region unit $12_1$ on which the line-sequential scan is completed first is a time ($15t_0$) from the beginning of the period $T_{11}$ to the end of the period $T_{25}$. Meanwhile, the wait time in the display region unit $12_4$ on which the line-sequential scan is completed last is a time from the beginning of the period $T_{40}$ to the end of the period $T_1'$, that is, 0 (nil) as with the reference example.

Also, the wait times in the display region units $12_2$ and $12_3$ positioned between the display region unit $12_1$ on which the line-sequential scan is completed first and the display region unit $12_4$ on which the line-sequential scan is completed last in one frame period are set so as to decrease in descending order in which the scan is completed.

In other words, as is shown in FIG. 6, the wait time in the display region unit $12_2$ is a time ($10t_0$) from the beginning of the period $T_{20}$ to the end of the period $T_{30}$. The wait time in the display region unit $12_3$ is a time ($5t_0$) from the beginning of the period $T_{31}$ to the end of the period $T_{35}$.

It is set in such a manner that the luminous period of the planar light source unit $41_4$ corresponding to the display region unit $12_4$ on which the line-sequential scan is completed last in a given frame period and the luminous period of the planar light source unit $41_1$ corresponding to the display region unit $12_1$ on which the line-sequential scan is completed first in the frame period following the given frame period will not overlap each other.

As is shown in FIG. 6, the luminous period of the planar light source unit $41_4$ corresponding to the display region unit $12_4$ on which the line-sequential scan is completed last in the frame period starting from the period $T_1$ is from the period $T_1'$ to the period $T_5'$. Also, the luminous period of the planar light source unit $41_1$ corresponding to the display region unit $12_1$ on which the line-sequential scan is completed first in the following frame period starting from the period $T_1'$ is from the period $T_{26}'$ to the period $T_{30}'$. In this manner, the former period and the latter period are set so as not to overlap each other.

Operation timing of the respective planar light source units 41 according to an embodiment of the present invention is the same as the operation timing of the planar light source units 41 according to the reference example described above except that the beginning is delayed by half the field period.

A period between the beginning of the luminous period of the planar light source unit $41_1$ corresponding to the display region unit $12_1$ on which the line-sequential scan has been completed first in a given frame period and the end of the luminous period of the planar light source unit $41_4$ corresponding to the display region unit $12_4$ on which the line-sequential scan has been completed last in this frame period forms the video display period. Also, a period between the end of the luminous period of the planar light source unit $41_4$ corresponding to the display region unit $12_4$ on which the line-sequential scan has been completed last in a give frame period and the beginning of the luminous period of the planar light source unit $41_1$ corresponding to the display region unit $12_1$ on which the line-sequential scan has been completed first in the frame period following the given frame period forms the black display period.

Hereinafter, an operation according to an embodiment of the present invention will be described with reference to FIG. 6, FIG. 11A through FIG. 11D, FIG. 12A through FIG. 12D, and FIG. 13A through FIG. 13C.

Periods $T_1$ through $T_5$ (See FIG. 6 and FIG. 11A)

A new frame period starts from the beginning of the period $T_1$. As is shown in FIG. 6, the control lines $BCL_1$, $BCL_2$, and $BCL_3$ stay at a low level and the control line $BCL_4$ stays at a high level during these periods. Hence, as is shown in FIG.

11A, the planar light source units $41_1$, $41_2$, and $41_3$ are in a non-luminous state whereas the planar light source unit $41_4$ is in a luminous state.

In the period $T_1$ through the period $T_5$, a part of the display region unit $12_1$ is scanned line-sequentially. In other words, in the period $T_1$ and the period $T_2$, the scan electrode $SCL_2$ changes to a high level and the light transmittances of the respective sub-pixels in the first row are controlled according to the control signals [R, G, B]. In the period $T_3$ and the period $T_4$, too, the scan electrode $SCL_2$ is scanned and the light transmittances of the respective sub-pixels in the second row are controlled in the same manner as above. In the period $T_5$ and in the period $T_6$ described below, the scan electrode $SCL_3$ is scanned and the light transmittances of the respective sub-pixels in the third row are controlled in the same manner as above.

A portion of the display region unit $12_1$ that has not been scanned line-sequentially and the display region units $12_2$, $12_3$, and $12_4$ hold a state of having been scanned in the preceding frame period.

As has been described, in the period $T_1$ through the period $T_5$, a part of the display region unit $12_1$ is scanned line-sequentially but the planar light source units $41_1$, $41_2$, $41_3$ are in a non-luminous state whereas the planar light source unit $41_4$ is in a luminous state. Accordingly, a video according to the light transmittances of the respective sub-pixels in the display region unit $12_4$ is displayed. The end of the period $T_5$ corresponds to the end of the preceding video display period.

Periods $T_6$ through $T_{25}$ (See FIG. 6 and FIG. 11B and FIG. 11C)

In the period $T_6$ through the period $T_{25}$, the remaining portion of the display region unit $12_1$, the display region unit $12_2$, and a part of the display region unit $12_3$ are scanned line-sequentially. Also, a new black display period starts from the beginning of the period $T_6$.

The scan electrode $SCL_3$ is scanned in the period $T_5$ described above and in the period $T_6$. The scan electrode $SCL_4$ is scanned in the period $T_7$ and the period $T_8$. Thereafter, the scan electrodes $SCL_5$ through $SCL_{13}$ are scanned sequentially. It should be noted that the scan electrode $SCL_{13}$ is scanned in the period $T_{25}$ and in the period $T_{26}$ described below. The light transmittances of the respective sub-pixels in the fourth row through the thirteenth row are controlled in the same manner as above.

Meanwhile, the control line $BCL_4$ changes from a high level to a low level at the beginning of the period $T_6$. The planar light source unit $41_4$ thus changes to a non-luminous state. The control lines $BCL_2$ through $BCL_4$ stay at a low level. The planar light source units $41_1$, $41_2$, and $41_3$ therefore remain in a non-luminous state. The liquid crystal display thus changes to a black display state. The beginning of the period $T_6$ corresponds to the beginning of the black display period and the end of the period $T_{26}$ corresponds to the end of the black display period.

Periods $T_{26}$ through $T_{30}$ (See FIG. 6, FIG. 11D, and FIG. 12A)

In the period $T_{26}$ through the period $T_{30}$, the remaining portion of the display region unit $12_3$ is scanned line-sequentially. Also, a new video display period starts from the beginning of the period $T_{26}$. The scan electrode $SCL_{13}$ is scanned in the period $T_{25}$ described above and in the period $T_{26}$. The scan electrode $SCL_{14}$ is scanned in the period $T_{27}$ and the period $T_{28}$ and the scan electrode $SCL_{15}$ is scanned in the period $T_{29}$ and the period $T_{30}$. The light transmittances of the respective sub-pixels in the fourteenth row and the fifteenth row are controlled in the same manner as above.

The control line $BCL_1$ changes from a low level to a high level at the beginning of the period $T_{26}$. The planar light source unit $41_1$ thus changes to a luminous state. Meanwhile, the control lines $BCL_2$, $BCL_3$, and $BCL_4$ stay at a low level. The planar light source units $41_2$, $41_3$, and $41_4$ therefore remain in a non-luminous state. Accordingly, a video according to the light transmittances of the respective sub-pixels in the display region unit $12_1$ is displayed.

Periods $T_{31}$ through $T_{35}$ (See FIG. 6 and FIG. 12B and FIG. 12C)

In the period $T_{31}$ through the period $T_{35}$, a part of the display region unit $12_4$ is scanned line-sequentially. The scan electrode $SCL_{16}$ is scanned in the period $T_{31}$ and the period $T_{32}$. The scan electrode $SCL_{17}$ is scanned in the period $T_{33}$ and the period $T_{34}$ and the scan electrode $SCL_{18}$ is scanned in the period $T_{35}$ and in the period $T_{36}$ described below. The light transmittances of the respective sub-pixels in the sixteenth row through the eighteenth row are controlled in the same manner as above.

The control line $BCL_2$ changes from a low level to a high level at the beginning of the period $T_{31}$. The planar light source unit $41_2$ thus changes to a luminous state. Meanwhile, the control line $BCL_1$ changes from a high level to a low level at the beginning of the period $T_{31}$. The planar light source unit $41_1$ thus changes to a non-luminous state. The control lines $BCL_3$ and $BCL_4$ stay at a low level. The planar light source units $41_3$ and $41_4$ therefore remain in a non-luminous state. Accordingly, a video corresponding to the light transmittances of the respective sub-pixels in the display region unit $12_2$ is displayed.

Periods $T_{36}$ through $T_{40}$ (See FIG. 6, FIG. 12D, and FIG. 13A)

In the period $T_{36}$ through the period $T_{40}$, the remaining portion of the display region unit $12_4$ is scanned line-sequentially. The scan electrode $SCL_{18}$ is scanned in the period $T_{35}$ described above and in the period $T_{36}$. The scan electrode $SCL_{19}$ is scanned in the period $T_{37}$ and the period $T_{38}$. The scan electrode $SCL_{20}$ is scanned in the period $T_{39}$ and the period $T_{40}$. The light transmittances of the respective sub-pixels in the nineteenth row and the twentieth row are controlled in the same manner.

The control line $BCL_2$ changes from a high level to a low level at the beginning of the period $T_{36}$. The planar light source unit $41_2$ thus changes to a non-luminous state. Meanwhile, the control line $BCL_3$ changes from a low level to a high level at the beginning of the period $T_{36}$. The planar light source unit $41_3$ thus changes to a luminous state. The control lines $BCL_1$ and $BCL_4$ stay at a low level. The planar light source units $41_1$ and $41_4$ therefore remain in a non-luminous state. Accordingly, a video according to the light transmittances of the respective sub-pixels in the display region unit $12_3$ is displayed.

Periods $T_1'$ through $T_5'$ (See FIG. 6 and FIG. 13B and FIG. 13C)

The following frame period starts at the beginning of the period $T_1'$. As with the description of the period $T_1$ through the period $T_5$ above, a part of the display region unit $12_1$ is scanned line-sequentially and the light transmittances of the respective sub-pixels in the first row through the third row are controlled in the same manner as above. The remaining portion of the display region unit $12_1$ and the display region units $12_2$, $12_3$, and $12_4$ hold a state of having been scanned in the immediately preceding frame period.

The control line $BCL_3$ changes from a high level to a low level at the beginning of the period $T_1'$. The planar light source unit $41_3$ thus changes to a non-luminous state. Meanwhile, the control line $BCL_4$ changes from a low level to a high level at the begging of the period $T_1'$. The planar light source unit $\mathbf{41}_4$ thus changes to a luminous state. The control lines $BCL_1$ and $BCL_2$ stay at a low level. The planar light source units $\mathbf{41}_1$ and $\mathbf{41}_2$ therefore remain in a non-luminous state. Accordingly, a video corresponding to the light transmittances of the respective sub-pixels in the display region unit $\mathbf{12}_4$ is displayed. The end of the period $T_5'$ corresponds to the end of the video display period.

The operation according to the embodiment of the present invention has been described. As is shown in FIG. 7A to FIG. 7D, both the video display periods and the black display periods account for half the frame period in each of the reference example and the embodiment of the present invention. Hence, the liquid crystal display exhibits the same moving picture characteristic in operations according to the reference example and the embodiment of the present invention.

According to the reference example, only half the frame period is allocated to the scan on the liquid crystal display device. On the contrary, according to the embodiment of the present invention, the entire frame period can be allocated to the scan on the liquid crystal display device. In other words, there is an advantage that a timing margin in the scan is not reduced because the scan period of the liquid crystal display device does not become shorter even when a black display period is inserted. Also, with the driving method according to the reference example, the scan frequency becomes higher as the scan period becomes shorter, which consequently causes an increase of power consumption in association with the scan on the liquid crystal display device. The embodiment of the present invention, however, also has an advantage that power consumption is not particularly increased in association with the scan on the liquid crystal display device.

In a case where right-eye images and left-eye images for a 3D image display are displayed alternately in the operation according to the embodiment of the present invention, for example, a right-eye image is displayed in the period $T_6$ through the period $T_{25}$ shown in FIG. 6 and a left-eye image is displayed in the period $T_6'$ through the period $T_{25}'$. In this case, the right-eye image and the left-eye image are completely isolated in terms of time by the black display period in the period $T_{26}$ through the period $T_5'$. Hence, when viewed via eye glasses that close the field of view of the left eye of the observer during a display period of a right-eye image and close the field of view of the right eye of the observer during a display period of a left-eye image, it becomes possible to obtain a satisfactory 3D image display.

Figure 14:
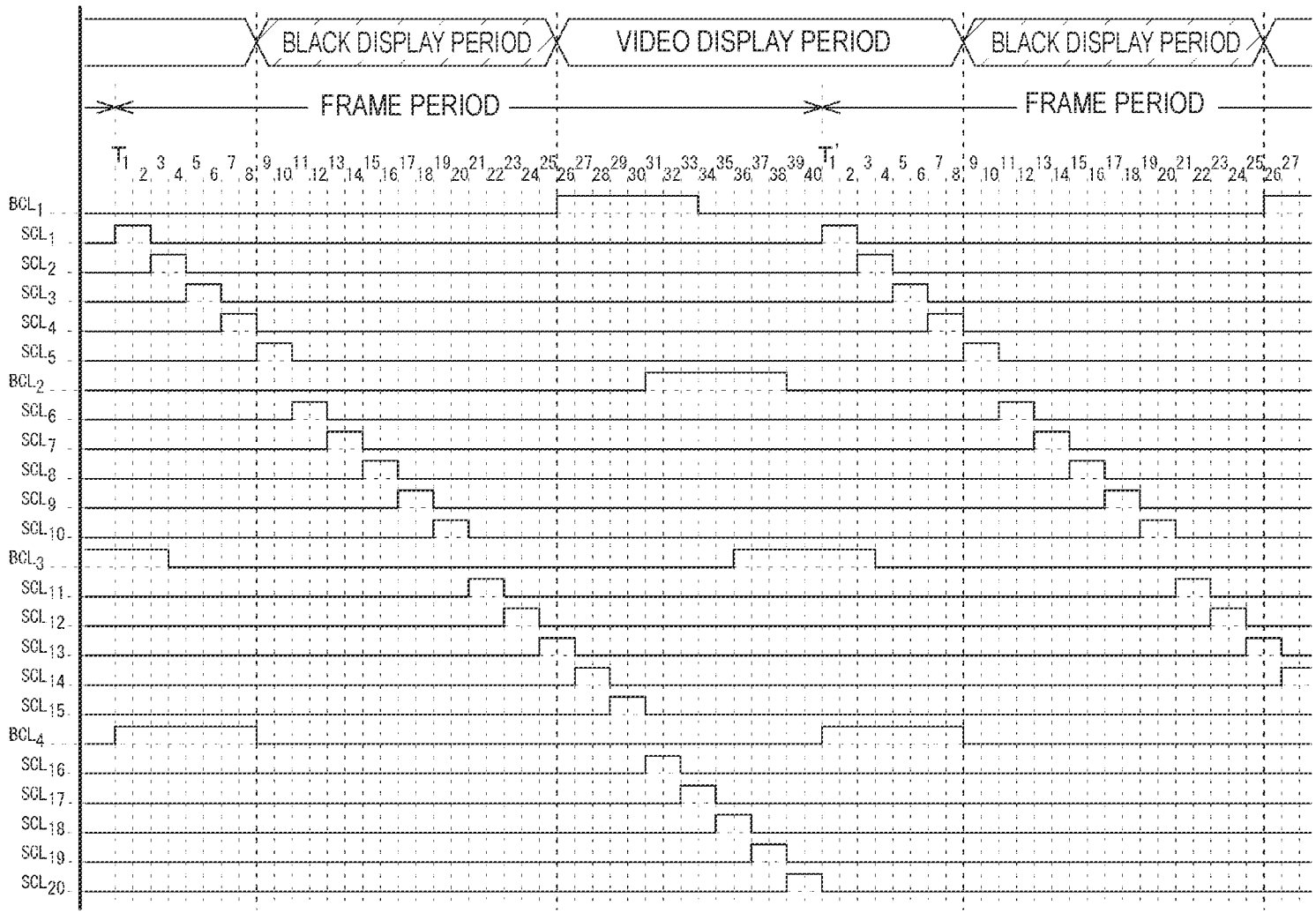
FIG. 14 is a schematic timing chart of an operation of a liquid crystal display according to a modification.

In the operation of FIG. 6, it is set in such a manner that the luminous periods of the planar light source unit $\mathbf{41}_1$ and the planar light source unit $\mathbf{41}_2$, those of the luminous periods of the planar light source unit $\mathbf{41}_2$ and the planar light source unit $\mathbf{41}_3$, and those the luminous periods of the planar light source unit $\mathbf{41}_3$ and the planar light source unit $\mathbf{41}_4$ do not over lap each other. It should be appreciated, however, that an embodiment of the present invention is not limited to this configuration. As is shown in FIG. 14, it may be configured in such a manner that the luminous period in a stage and the luminous period in the following stage may overlap partially.

While the embodiments of the present invention have been described, it should be appreciated that the present invention is not limited to the embodiments described above. The configurations and the structures of the transmissive color liquid crystal display device, the planar light source device, the planar light source units, the liquid crystal display, and the drive circuit described above are mere examples. In addition, members and materials forming the foregoing components are described by way of example and the driving process of the liquid crystal display is also described by way of example. It is therefore possible to change the members, the materials, and the driving process so as to suit the circumstances.

The present application contains subject matter related to that disclosed in Japanese Priority Patent Application JP 2009-017946 filed in the Japan Patent Office on Jan. 29, 2009, the entire contents of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A liquid crystal display comprising:

a transmissive liquid crystal display device having a display region made up of pixels arrayed in a matrix fashion, wherein the display region is divided into a plurality of display region units, and wherein each display region unit is made up of a plurality of pixels, wherein the liquid crystal display device includes;

a light source device that includes a plurality of planar light source units, wherein each planar light source unit irradiates a corresponding display region unit with light, and a drive circuit driving the liquid crystal display device and the light source device, wherein the liquid crystal display device is scanned line-sequentially and the pixels making up each display region unit are scanned line-sequentially, wherein for each display region unit a corresponding planar light source unit is held in a luminous state over a predetermined period until the line-sequential scan on the corresponding display region unit has been completed, wherein a luminous period of the planar light source unit corresponding to the display region unit on which the line-sequential scan is completed last in a given frame period and a luminous period of the planar light source unit corresponding to the display region unit on which the line-sequential scan is completed first in a frame period following the given frame period are set so as not to overlap each other, wherein a wait time after the line-sequential scan on any one of the display region units has been completed until the planar light source unit corresponding to that display region unit changes to a luminous state is set in such a manner that a wait time in the display region unit on which the line-sequential scan is completed first and a wait time in the display region unit on which the line-sequential scan is completed last in one frame period become longest and shortest, respectively, and wherein wait times in display region units positioned between the display region unit on which the line-sequential scan is completed first and the display region unit on which the line-sequential scan is completed last in the one frame are set so as to decrease in descending order in which the scan is completed.

2. A liquid crystal display comprising:

a transmissive liquid crystal display device having a display region made up of pixels arrayed in a matrix fashion, wherein the region is divided into a plurality of display region unit, and wherein each display region unit is made up of a plurality of pixels;

a light source device that includes a plurality of planar light source units, wherein each planar light source unit irradiates a corresponding display region unit with light; and a drive circuit driving the liquid crystal display device and the planar light source device, wherein the liquid crystal display device is scanned line-sequentially and the pixels making up each display region unit are scanned line-sequentially, wherein for each display region unit a corresponding planar light source unit is held in a luminous state over a predetermined period until the line-sequential scan on the corresponding display region unit has been completed, wherein a luminous period of the planar light source unit corresponding to the display region unit on which the line-sequential scan is completed last in a given frame period and a luminous period of the planar light source unit corresponding to the display region unit on which the line-sequential scan is completed first in a frame period following the given frame period are set so as not to overlap each other, wherein a wait time after the line-sequential scan on any one of the display region units has been completed until the planar light source unit corresponding to that display region unit changes to a luminous state is set in such a manner that a wait time in the display region unit on which the line-sequential scan is completed first and a wait time in the display region unit on which the line-sequential scan is completed last in one frame period become longest and shortest, respectively, and wherein wait times in display region units positioned between the display region unit on which the line-sequential scan is completed first and the display region unit on which the line-sequential scan is completed last in the one frame are set so as to decrease in descending order in which the scan is completed.

3. The liquid crystal display according to claim 2, wherein a period between a beginning of the luminous period of the planar light source unit corresponding to the display region unit on which the line-sequential scan has been completed first in the given frame period and an end of the luminous period of the planar light source unit corresponding to the display region unit on which the line-sequential scan has been completed last in the given frame period forms a video display period.

4. The liquid crystal display according to claim 2, wherein a period between an end of the luminous period of the light source unit corresponding to the display region unit on which the line-sequential scan has been completed last in the given frame period and a beginning of the luminous period of the light source unit corresponding to the display region unit on which the line-sequential scan has been completed first in the frame period following the given frame period forms a black display period.

5. A driving method of a liquid crystal display including a transmissive liquid crystal display device having a display region made up of pixels arrayed in a matrix fashion, wherein the display region is divied into a plurality of display region units, and wherein each display region unit is made up of a plurality of pixels, a light source device that includes a plurality of planar light source units, wherein each planar light source unit irradiates a corresponding display region unit with light, and a drive circuit driving the liquid crystal display device and the planar light source device, the driving method comprising the steps of:

performing, with the use of the liquid crystal display, processing to scan the liquid crystal display device line-sequentially and to scan the pixels making up each display region unit line-sequentially; and performing processing to hold the planar light source unit corresponding to each display region unit in a luminous state over a predetermined period since a line-sequential scan on the display region unit has been completed, wherein a luminous period of the planar light source unit corresponding to the display region unit on which the line-sequential scan is completed last in a given frame period and a luminous period of the planar light source unit corresponding to the display region unit on which the line-sequential scan is completed first in a frame period following the given frame period are set so as not to overlap each other, wherein a wait time after the line-sequential scan on any one of the display region units has been completed until the planar light source unit corresponding to that display region unit changes to a luminous state is set in such a manner that a wait time in the display region unit on which the line-sequential scan is completed first and a wait time in the display region unit on which the line-sequential scan is completed last in one frame period become longest and shortest, respectively, and wherein wait times in display region units positioned between the display region unit on which the line-sequential scan is completed first and the display region unit on which the line-sequential scan is completed last in the one frame are set so as to decrease in descending order in which the scan is completed.

6. The driving method of a liquid crystal display according to claim 5, wherein a period between a beginning of the luminous period of the planar light source unit corresponding to the display region unit on which the line-sequential scan has been completed first in the given frame period and an end of the luminous period of the planar light source unit corresponding to the display region unit on which the line-sequential scan has been completed last in the given frame period forms a video display period.

7. The driving method of a liquid crystal display according to claim 5, wherein a period between an end of the luminous period of the light source unit corresponding to the display region unit on which the line-sequential scan has been completed last in the given frame period and a beginning of the luminous period of the light source unit corresponding to the display region unit on which the line-sequential scan has been completed first in the frame period following the given frame period forms a black display period.

* * * * *